US008216024B2

(12) United States Patent
Hamanaka et al.

(10) Patent No.: US 8,216,024 B2
(45) Date of Patent: Jul. 10, 2012

(54) SPECTACLE LENS EDGING METHOD

(75) Inventors: Akira Hamanaka, Tokyo (JP); Takashi Daimaru, Tokyo (JP); Ryo Terai, Tokyo (JP)

(73) Assignee: Hoya Corporation, Tokyo (JP)

( * ) Notice: Subject to any disclaimer, the term of this patent is extended or adjusted under 35 U.S.C. 154(b) by 513 days.

(21) Appl. No.: 12/531,487

(22) PCT Filed: Mar. 17, 2008

(86) PCT No.: PCT/JP2008/054914

§ 371 (c)(1),
(2), (4) Date: Sep. 15, 2009

(87) PCT Pub. No.: WO2008/114781

PCT Pub. Date: Sep. 25, 2008

(65) Prior Publication Data

US 2010/0105293 A1 Apr. 29, 2010

(30) Foreign Application Priority Data

Mar. 16, 2007 (JP) ..... 2007-069047

(51) Int. Cl.
*B24B 41/00* (2006.01)
*B24B 1/00* (2006.01)

(52) U.S. Cl. ..... 451/5; 451/6; 451/8; 451/43

(58) Field of Classification Search ..... 451/5, 6, 451/8, 11, 41, 43
See application file for complete search history.

(56) References Cited

U.S. PATENT DOCUMENTS 5,347,762 A * 9/1994 Shibata et al. ..... 451/5
RE35,898 E * 9/1998 Shibata et al. ..... 451/5
2003/0220056 A1* 11/2003 Wada et al. ..... 451/177
2003/0227690 A1* 12/2003 Jinbo et al. ..... 359/643
2010/0112915 A1* 5/2010 Annaka ..... 451/384

FOREIGN PATENT DOCUMENTS

| | | | |
|---|---|---|---|
| JP | 11-333684 | A | 12/1999 |
| JP | 11-333685 | A | 12/1999 |
| JP | 2000-015549 | | 1/2000 |
| JP | 2002-182011 | A | 6/2002 |
| JP | 2003-300138 | A | 10/2003 |
| JP | 2004-122238 | A | 4/2004 |
| JP | 2004-122302 | A | 4/2004 |
| JP | 2004-276221 | | 10/2004 |
| JP | 2006-239782 | A | 9/2006 |
| JP | 2006-305702 | A | 11/2006 |
| JP | 2006-330677 | A | 12/2006 |
| JP | 2006-334701 | A | 12/2006 |

* cited by examiner

*Primary Examiner* — Maurina Rachuba

(74) *Attorney, Agent, or Firm* — Blakely, Sokoloff, Taylor & Zafman

(57) ABSTRACT

A lens holder (16) is attached to a processing target lens (2) such that a holder center (O) coincides with a processing center position (21) of the lens. An axial deviation measuring mark (81*a*, 81*b*) is displayed on the processing target lens (2) to coincide with a reference position mark (80*a*, 80*b*) of the lens holder (16), and the circumferential surface of the processing target lens (2) undergoes primary processing. After primary processing, the axial deviation of the processing target lens (2) is measured from the reference position mark (80*a*, 80*b*) and axial deviation measuring mark (81*a*, 81*b*). When axial deviation exists, the lens holder (16) is removed from the processing target lens (2) and the processing target lens (2) is held again, so that the axial deviation is corrected. After that, the processing target lens (2) undergoes secondary processing.

4 Claims, 8 Drawing Sheets

SPECTACLE LENS EDGING METHOD

This is a non-provisional application claiming the benefit of International application number PCT/JP2008/054914 filed Mar. 17, 2008.

TECHNICAL FIELD

The present invention relates to a spectacle lens edging method.

BACKGROUND ART

When fabricating a spectacle lens having an edged lens shape complying with the frame shape of a spectacle frame by grinding the circumferential surface of an unprocessed round lens (to be also referred to as an uncut lens or a processing target lens hereinafter), if the lens is held with a weak force, the processing resistance applied by a grinding stone may cause axial deviation of the lens. More specifically, the processing center position of the actual lens may deviate from the lens rotating shaft. The axial deviation of the lens appears in a direction (radial direction) perpendicular to the processing center position when the lens does not have a cylinder axis, and includes deviation in the direction perpendicular to the processing center position and deviation in the rotational direction with respect to the processing center position when the lens has a cylinder axis. To solve this problem, conventionally, various methods have been proposed such as increasing the lens holding force, or employing an edging apparatus, an edging method, and an adhesive tape as described in Japanese Patent Laid-Open Nos. 2003-300138, 11-333684, 11-333685, 2002-182011, and 2004-122302.

The lens processing method and processing apparatus described in Japanese Patent Laid-Open No. 2003-300138 improve the processing accuracy of the circumferential surface of a lens without requiring in advance the design data of the lens to be finished. Hence, according to this lens processing method, the processing target lens is roughly processed based on the lens frame shape data of a spectacle frame or shape data that can comply with a spectacle, and thereafter the shape of the lens is measured. Then, the lens is finished to a shape complying with the shape of the spectacle frame or a shape complying with the spectacle based on the rough processing shape data obtained by the measurement.

The spectacle lens processing apparatus described in Japanese Patent Laid-Open No. 11-333684 processes a lens highly accurately by preventing axial deviation, breaking of the lens, and coat cracking. For this purpose, this spectacle lens processing apparatus includes a first lens chuck shaft on which a processing target lens is mounted through a fixing cup, a second lens chuck shaft which is arranged coaxially with the first lens chuck shaft and on which a lens retaining member to retain the processing target lens is attached, a rotational deviation detection means for detecting the deviations of the rotation angles of the lens chuck shafts, and a process control means which processes the processing target lens based on the detection result obtained by the rotational deviation detection means.

The spectacle lens processing apparatus described in Japanese Patent Laid-Open No. 11-333685 allows processing a processing target lens under appropriate conditions in accordance with the shape of the lens under processing. To achieve this, according to the spectacle lens processing apparatus, an encoder provided to a servo motor detects the travel amount (the shaft-to-shaft distance between a lens chuck shaft and the rotating shaft of a grinding wheel) of a carriage. An obtained detection signal is sent to a controller. The controller measures the during-processing shape corresponding to the rotation angle of the lens from an input signal. The processing pressure (the preset value of the rotary torque) is changed to correspond to the during-processing shape. More specifically, when the lens chuck shaft is distant from a processing end portion, the process is started after decreasing the processing pressure by lowering the carriage. As the distance to the processing end decreases, the processing pressure is increased gradually. When the processing pressure is changed depending on a lens processing diameter in this manner, axial deviation can be suppressed, and highly accurate processing can be performed.

According to the technique described in Japanese Patent Laid-Open Nos. 2002-182011 and 2004-122302, a double-coated adhesive tape or a coating film is formed between a processing target lens and a lens holding means, so that slipping is prevented.

DISCLOSURE OF INVENTION

Problem to be Solved by the Invention

In recent years, a spectacle lens with an optical surface on which a water-repellent film layer is formed to improve the repellency of the lens is becoming popular, as disclosed in, e.g., Japanese Patent Laid-Open No. 2004-122238. When edging a processing target lens which has such a water-repellent film layer, because of the presence of the water-repellent film layer, the optical surface of the lens is much smoother than that of any other currently available lens. More specifically, since the lens surface is slippery, with the conventional processing apparatus as described in Japanese Patent Laid-Open Nos. 2003-300138, 11-333684, or 11-333685, it is difficult to hold the lens reliably. During edging, slipping occurs between the lens holding means and the lens, making it difficult to process the processing target lens into a predetermined edged lens shape. Particularly, when the lens is a minus-power lens having a high dioptric power, as the peripheral edge is very thick, the processing resistance at the start of processing is large and axial deviation occurs easily. As a result, it is difficult to process the lens highly accurately.

When adopting the methods of preventing axial deviation which increase the lens holding force by employing the adhesive tape or forming the coating film described in Japanese Patent Laid-Open Nos. 2002-182011 and 2004-122302, if air enters between the lens surface and the tape or coating film, it decreases the lens holding force. If the lens has high lubricating properties or the peripheral edge of the lens has a relatively large thickness, axial deviation cannot be prevented completely.

When the method of increasing the lens holding force is employed, it may break the lens itself or damage the coating film formed on the lens surface. Thus, this method has limitations in increasing the holding force.

The present invention has been made to solve the above conventional problems, and has its object to provide a spectacle lens edging method which can produce a highly accurate spectacle lens eventually free from axial deviation even from a stainproof lens having a high lubricating properties or a lens having relatively thick peripheral edge.

Means of Solution to the Problems

In order to achieve the above object, according to the present invention, there is provided a spectacle lens edging method comprising the steps of holding a processing target lens by lens holding means, mounting the lens holding means on a lens rotating shaft together with the processing target lens, and processing a circumferential surface of the processing target lens using a processing tool by primary processing and secondary processing, the step of holding the processing target lens by the lens holding means further comprising the steps of holding the processing target lens such that a center of the lens holding means coincides with a processing center of the processing target lens, and displaying an axial deviation measuring mark on one optical surface of the processing target lens so as to coincide with a reference position mark displayed on the lens holding means, and the method further comprising the step of correcting axial deviation of the processing target lens after primary processing.

Effect of the Invention

According to the present invention, in a primary processing step, axial deviation is measured after processing the lens with no specific axial deviation preventive countermeasures. If axial deviation is observed, it is corrected by holding the lens correctly with the lens holding means, and thereafter secondary processing is performed. Thus, axial deviation in secondary processing can be prevented. More specifically, as primary processing includes edging an uncut lens, the processing resistance is high at the start of processing. If the lens has a large diameter or the lens has high lubrication properties due to a water-repellent film layer, axial deviation tends to occur. In secondary processing, the lens has a small diameter. Thus, the processing resistance is low. Even if the lens has high lubrication properties or the lens in primary processing is an uncut lens with a large diameter, it need not be held with a particularly large lens holding force, and will not cause axial deviation easily, in the same manner as a general lens.

BEST MODE FOR CARRYING OUT THE INVENTION

Figure 1:
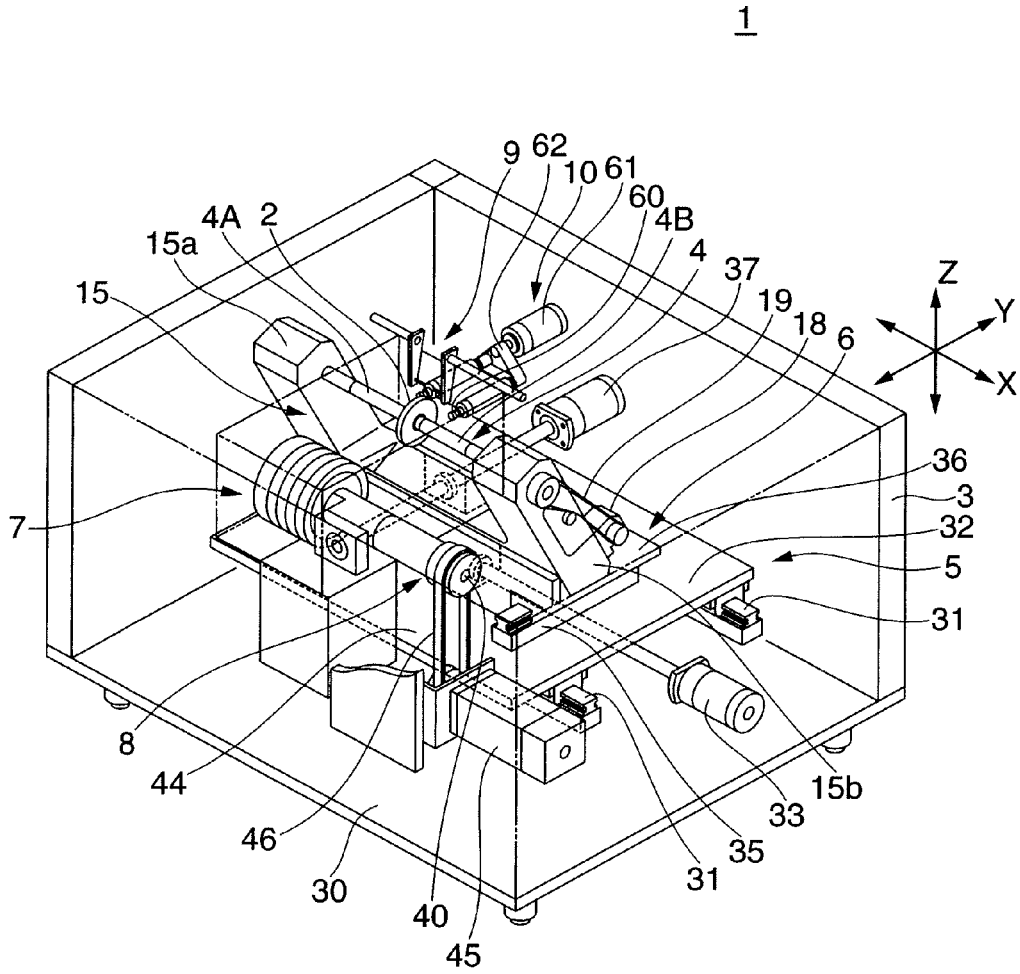
FIG. 1 is a schematic perspective view of an edging apparatus employed in a spectacle lens edging method according to the present invention.

The present invention will be described in detail based on embodiments shown in the accompanying drawings.

Referring to FIGS. 1 to 5, a spectacle lens edging apparatus denoted by reference numeral 1 is an apparatus to manufacture a spectacle lens 2A (FIG. 5A) having a desired edged lens shape by edging a processing target lens 2 formed of an unprocessed round lens, and includes a box-like housing 3 installed on a floor surface. A lens rotating shaft 4, a first lens rotating shaft moving mechanism 5, a second lens rotating shaft moving mechanism 6, a processing tool 7, a rotational drive mechanism 8 for the processing tool 7, a controller (not shown), a lens shape measurement unit 9, a chamfering mechanism 10 for the processing target lens 2, and the like are built in the housing 3. The processing target lens 2 is mounted on the lens rotating shaft 4 through a lens holding means. The first lens rotating shaft moving mechanism 5 moves the lens rotating shaft 4 in an axial direction (X direction). The second lens rotating shaft moving mechanism 6 similarly moves the lens rotating shaft 4 in a horizontal direction (Y direction) perpendicular to the axis. The processing tool 7 edges the processing target lens 2. The controller controls the entire apparatus. The lens shape measurement unit 9 measures optical surfaces 2*a* and 2*b* of the processing target lens 2. The upper surface of the housing 3 is provided with an operation panel (not shown) including a display and various types of operation buttons to input lens information on the processing target lens 2, information on a spectacle frame, processing conditions, and the like.

The processing target lens 2 is formed of a round (with a diameter of, e.g., 80 mm) plastic minus-power lens formed by casting and polymerization.

Examples of the optical base material of the processing target lens 2 include, e.g., a copolymer formed from methyl methacrylate and at least another monomer, a copolymer formed from diethylene glycol bis(allyl carbonate) and at least another monomer, and a vinyl copolymer containing polycarbonate, urethane, polystyrene, polyvinyl chloride, unsaturated polyester, polyethylene terephthalate, polyurethane, polythiourethane, sulfide utilizing an enthiol reaction, or sulfur. Although a urethane-based optical base material and an allyl-based optical base material are particularly preferable among these base materials, the present invention is not limited to them. The optical base material of the present invention is preferably a plastic optical base material, and more preferably a plastic optical base material for spectacles.

Figure 6:
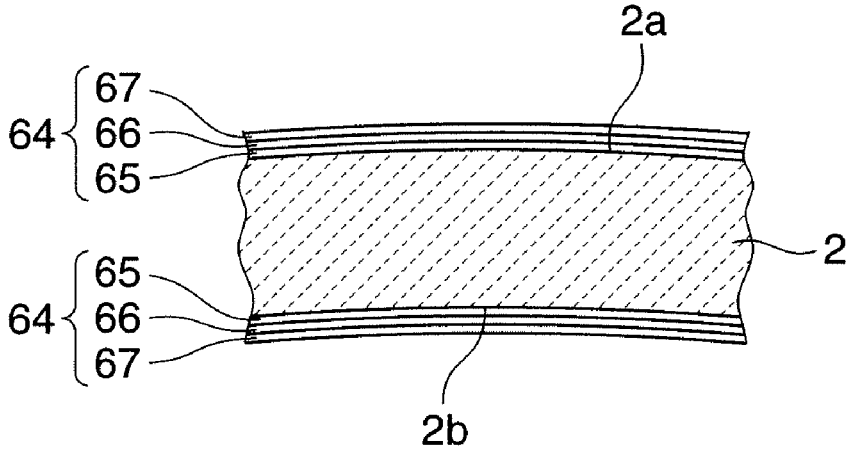
FIG. 6 is a sectional view of a main part showing protective film layers on the processing target lens.

As shown in FIG. 6, a protective film layer 64 and water-repellent film layer 67 are stacked on the entire surface of each of the optical surfaces 2*a* and 2*b* of the processing target lens 2. The protective film layer 64 is formed to improve the optical characteristics, durability, resistance to marring, and the like of the lens, and ordinarily includes a hard coat film layer 65 and antireflection film layer 66.

The lowermost hard coat film layer 65 is formed to enhance the hardness of the spectacle lens itself and improve the resistance to marring. As the material of the hard coat film layer 65, an organic substance such as a silicon-based resin is used. The hard coat film layer 65 is formed by applying a silicon-based resin made of a solvent by dipping or spin coating and curing the applied resin by heating in a heating furnace. This method of forming the hard coat film layer 65 is conventionally known well.

The antireflection film layer 66 as the intermediate layer is formed to enhance the antireflection effect and the resistance to marring. The antireflection film layer 66 is formed from a plurality of different materials so it forms a multilayered antireflection film layer. As an antireflecting material, for example, a metal oxide or silicon oxide of Zr, Ti, Sn, Si, In, Al, or the like, or $MgF_2$ is used. Such a multilayered antireflection film layer 66 is formed by vacuum deposition described in, e.g., Japanese Patent Laid-Open No. 11-333685 described above.

The multilayered antireflection film layer 66 is preferably formed by an ion-assisted deposition method so that it obtains a high film strength and good adhesion. The layers that form films other than a hybrid layer of the antireflection film are tantalum oxide ($Ta_2O_5$) layers serving as high-refractive layers so that physical properties such as a good antireflection effect and resistance to marring can be obtained. Each tantalum oxide layer contains preferably at least 50 wt % of tantalum oxide and more preferably 80 wt % or more of tantalum oxide.

According to the ion-assisted deposition method, the preferable output range of the acceleration voltage is 50 V to 700 V and that of the acceleration current is 30 mA to 250 mA from the viewpoint of obtaining a particularly good reaction. As an ionization gas used when practicing the ion-assisted deposition method, argon (Ar) or a gas mixture of argon and oxygen is preferably used in consideration of the reactivity and oxidation prevention during film formation.

The inorganic substance used in the hybrid layer of the present invention must include silicon dioxide and can include at least one member selected from the group consisting of aluminum oxide, titanium oxide, zirconium oxide, tantalum oxide, yttrium oxide, and niobium oxide. When using a plurality of inorganic substances, they may be mixed physically. Alternatively, the inorganic substance can be a composite oxide, e.g., silicon dioxide ($SiO_2$) or aluminum monoxide ($Al_2O_3$). Among them, silicon dioxide alone and at least one type of inorganic oxide selected from the group consisting of silicon dioxide and aluminum oxide are preferable.

As the organic substance used to form the hybrid layer of the present invention, an organic silicide which is liquid at normal temperature and normal pressure and/or an organic compound not containing silicon, which is liquid at normal pressure, is preferable from the viewpoint of film thickness control and deposition rate control.

The organic silicide preferably has any one of the structures represented by the following general formulas (a) to (d):

General formula (a): silane/siloxane compound

[Chemical 1]

(a)

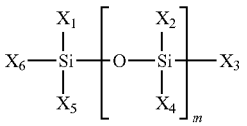

General formula (b): silazane compound

[Chemical 2]

(b)

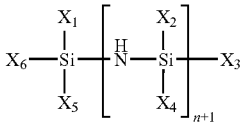

General formula (c): cyclosiloxane compound

[Chemical 3]

(c)

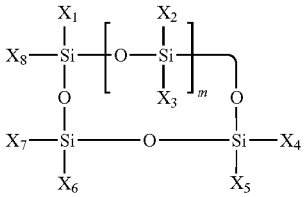

General formula (d): cyclosilazane compound

[Chemical 4]

(d)

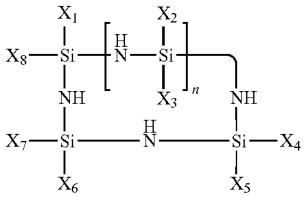

In general formulas (a) to (d), m and n each independently represent an integer of 0 or more. $X_1$ to $X_8$ each independently represent hydrogen, a hydrocarbon group (including both saturated and unsaturated hydrocarbon groups) having 1 to 6 carbon atoms, an —$OR^1$ group, a —$CH_2OR^2$ group, a —$COOR^3$ group, an —$OCOR^4$ group, an —$SR_5$ group, a —$CH_2SR^6$ group, an —$NR^7{}_2$ group, or a —$CH_2NR^8{}_2$ group [$R^1$ to $R^8$ each independently represent hydrogen or a hydrocarbon group (including both saturated and unsaturated hydrocarbon groups) having 1 to 6 carbon atoms. $X_1$ to $X_8$ may be arbitrary ones of the above functional groups and may all be the same or different.

Specific examples of the hydrocarbon group having 1 to 6 carbon atoms represented by $R^1$ to $R^8$ include a methyl group, ethyl group, n-propyl group, isopropyl group, n-butyl group, isobutyl group, pentyl group, hexyl group, vinyl group, allyl group, ethynyl group, phenyl group, cyclohexyl group, propenyl group, and isopropenyl group.

Specific examples of the compound represented by general formula (a) include trimethylsilanol, tetramethylsilane, diethylsilane, dimethylethoxysilane, hydroxymethyltrimethylsilane, methoxytrimethylsilane, dimethoxydimethylsilane, methyltrimethoxysilane, mercaptomethyltrimethoxysilane, tetramethoxysilane, mercaptomethyltrimethylsilane, aminomethyltrimethylsilane, dimethyl(dimethylamino)silane, ethynyltrimethylsilane, diacetoxymethylsilane, allyldimethylsilane, trimethylvinylsilane, methoxydimethylvinylsilane, acetoxytrimethylsilane, trimethoxyvinylsilane, diethylmethylsilane, ethyltrimethylsilane, ethoxytrimethylsilane, diethoxymethylsilane, ethyltrimethoxysilane, dimethylaminotrimethylsilane, bis(dimethylamino)methylsilane, phenylsilane, dimethyldivinylsilane, 2-propynyloxytrimethylsilane, dimethylethoxyethynylsilane, diacetoxydimethylsilane, allyltrimethylsilane, allyloxytrimethylsilane, ethoxydimethylvinylsilane, isopropenoxytrimethylsilane, allylaminotrimethylsilane, trimethylpropylsilane, trimethylisopropylsilane, triethylsilane, diethyldimethylsilane, butyldimethylsilane, trimethylpropoxysilane, trimethylisopropoxysilane, triethylsilanol, diethoxydimethylsilane, propyltrimethoxysilane, diethylaminodimethylsilane, bis(ethylamino)dimethylsilane, bis(dimethylamino)dimethylsilane, tri(dimethylamino)silane, methylphenylsilane, methyltrivinylsilane, diacetoxymethylvinylsilane, methyltriacetoxysilane, allyloxydimethylvinylsilane, diethylmethylvinylsilane, diethoxymethylvinylsilane, bis(dimethylamino)methylvinylsilane, butyldimethylhydroxymethylsilane, 1-methylpropoxytrimethylsilane, isobutoxytrimethylsilane, butoxytrimethylsilane, butyltrimethoxysilane, methyltriethoxysilane, isopropylaminomethyltrimethylsilane, diethylaminotrimethylsilane, methyltri(dimethylamino)silane, dimethylphenylsilane, tetravinylsilane, triacetoxyvinylsilane, tetraacetoxysilane, ethyltriacetoxysilane, diallyldimethylsilane, 1,1-dimethylpropynyloxytrimethylsilane, diethoxydivinylsilane, butyldimethylvinylsilane, dimethylisobutoxyvinylsilane, acetoxytriethylsilane, triethoxyvinylsilane, tetraethylsilane, dimethyldipropylsilane, diethoxydiethylsilane, dimethyldipropoxysilane, ethyltriethoxysilane, tetraethoxysilane, methylphenylvinylsilane, phenyltrimethylsilane, dimethylhydroxymethylphenylsilane, phenoxytrimethylsilane, dimethoxymethylphenylsilane, phenyltrimethoxysilane, anilinotrimethylsilane, 1-cyclohexenyloxytrimethylsilane, cyclohexyloxytrimethylsilane, dimethylisopentyloxyvinylsilane, allyltriethoxysilane, tripropylsilane, butyldimethyl-3-hydroxypropylsilane, hexyloxytrimethylsilane, propyltriethoxysilane, hexyltrimethoxysilane, dimethylphenylvinylsilane, trimethylsilylbenzonate, dimethylethoxyphenylsilane, methyltriisopropenoxysilane, methoxytripropylsilane, dibutoxydimethylsilane, methyltripropoxysilane, bis(butylamino)dimethylsilane, divinylmethylphenylsilane, diacetoxymethylphenylsilane, diethylmethylphenylsilane, diethoxymethylphenylsilane, triisopropoxyvinylsilane, 2-ethylhexyloxytrimethylsilane, pentyltriethoxysilane, diphenylsilane, diphenylsilanediolphenyltrivinylsilane, triethylphenylsilane, phenyltriethoxysilane, tetraallyloxysilane, phenyltri(dimethylamino)silane, tetrapropoxysilane, tetraisopropoxysilane, diphenylmethylsilane, diallylmethylphenylsilane, dimethyldiphenylsilane, dimethoxydiphenylsilane, dianilinodimethylsilane, diphenylethoxymethylsilane, tripentyloxysilane, diphenyldivinylsilane, diacetoxydiphenylsilane, diethyldiphenylsilane, diethoxydiphenylsilane, bis(dimethylamino)diphenylsilane, tetrabutylsilane, tetrabutoxysilane, triphenylsilane, diallyldiphenylsilane, trihexylsilane, triphenoxyvinylsilane, 1,1,3,3-tetramethyldisiloxane, pentamethyldisiloxane, hexamethyldisiloxane, 1,3-dimethoxytetramethyldisiloxane, 1,3-diethinyl-1,1,3,3-tetramethyldisiloxane, 1,3-divinyl-1,1,3,3-tetramethyldisiloxane, 1,3-diethoxytetramethyldisiloxane, hexaethyldisiloxane, and 1,3-dibutyl-1,1,3,3-tetramethyldisiloxane.

Specific examples of the compound represented by general formula (b) include 1,1,3,3-tetramethyldisilazane, hexamethyldisilazane, and 1,3-divinyl-1,1,3,3-tetramethyldisilazane.

Specific examples of the compound represented by general formula (c) include hexamethylcyclotrisiloxane, hexaethylcyclotrisiloxane, 1,3,5,7-tetramethylcyclotetrasiloxane, and octamethylcyclotetrasiloxane.

Specific examples of the compound represented by general formula (d) include 1,1,3,3,5,5-hexamethylcyclotrisilazane and 1,1,3,3,5,5,7,7-octamethylcyclotetrasilazane.

The number average molecular weights of these organosilicon compounds fall within the range of preferably 48 to 600 and most preferably 140 to 500 from the viewpoint of control of organic components in hybrid films and the strengths of the films themselves.

A non-silicon-containing organic compound of the hybrid layer includes preferably a compound containing hydrogen and carbon as indispensable components and having a reactive group at its side chain or terminal, and more specifically a compound represented by general formulas (e) to (g).

General formula (e): non-silicon-containing organic compound containing carbon and hydrogen as indispensable components and having an epoxy group at one terminal

[Chemical 5]

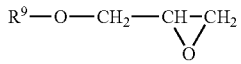

(e)

General formula (f): non-silicon-containing organic compound containing carbon and hydrogen as indispensable components and having epoxy groups at two terminals

[Chemical 6]

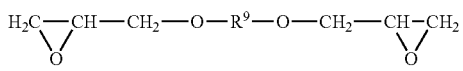

(f)

General formula (g): non-silicon-containing organic compound containing carbon and hydrogen as indispensable components and having a double bond $$CX_9X_{10}=CX_{11}X_{12} \quad (g)$$

In general formulas (e) and (f), $R^9$ represents hydrogen or a hydrocarbon group which has 1 to 10 carbon atoms and may contain oxygen, and $R^{10}$ represents a divalent hydrocarbon group which has 1 to 7 carbon atoms and may contain oxygen. In general formula (g), $X_9$ to $X_{12}$ each independently represent hydrogen, a hydrocarbon group having 1 to 10 carbon atoms, or an organic group containing hydrogen and carbon having 1 to 10 carbon atoms as indispensable components and at least one of oxygen and nitrogen as an indispensable component.

Specific examples of the compound represented by general formula (e) include methyl glycidyl ether, butyl glycidyl ether, 2-ethylhexydyl glycidyl ether, decyl glycidyl ether, stearyl glycidyl ether, allyl glycidyl ether, phenyl glycidyl ether, p-sec-butylphenyl glycidyl ether, p-tert-butylphenyl glycidyl ether, 2-methyloctyl glycidyl ether, glycidol, trimethylol, and propane polyglycidyl ether.

Specific examples of the compound represented by general formula (f) include neopentyl glycol diglycidyl ether, glycerol diglycidyl ether, glycerol triglycidyl ether, propylene glycol diglycidyl ether, tripropylene glycol diglycidyl ether, polypropylene glycol diglycidyl ether, 1,6-hexanediol diglycidyl ether, ethylene glycol diglycidyl ether, diethylene glycol diglycidyl ether, and polyethylene glycol diglycidyl ether.

Specific examples of general formula (g) include ethylene, propylene, vinyl chloride, vinyl fluoride, acrylamide, vinylpyrrolidone, vinylcarbazole, methyl methacrylate, ethyl methacrylate, benzyl methacrylate, n-butyl methacrylate, isobutyl methacrylate, dimethyl amino ethyl methacrylate, methacrylic acid, glycidyl methacrylate, vinyl acetate, and styrene.

The number average molecular weights of these compounds represented by general formulas (e) to (g) fall within the range of preferably 28 to 4,000 and most preferably 140 to 360 in consideration of control of organic components in hybrid films and the strengths of the films themselves.

As a method of forming an organosilicon compound which is liquid at normal temperature and normal pressure and/or a non-silicon-containing organic compound (to be also referred to as an organic material hereinafter) which is liquid at normal temperature and normal pressure, it is preferable to simultaneously deposit hybrid films using different vapor sources of inorganic and organic materials. More specifically, an inorganic material is heated to evaporate using an electron gun or the like. An organic material is stored in an external tank and evaporated in this tank. The inorganic and organic materials are then simultaneously deposited.

Preferably, the external tank which stores an organic material is heated and evacuated, the organic material is supplied to the chamber, and oxygen gas and/or argon gas is used to perform ion-assisted deposition in view of deposition rate control. In the present invention, the organic material is liquid at normal temperature and normal pressure. The present invention does not need a solvent, and allows direct heating and evaporation of the organic material. It is effective to arrange the supply port of the organic material right above the inorganic material vapor source to improve impact resistance and wear resistance. It is preferable to supply the organosilicon compound upward and supply downward the non-silicon-containing organic compound having a reactive group at its side chain or terminal and containing carbon and hydrogen as indispensable components.

The heating temperature of the external tank falls within the range of 30 to 200° C. and preferably 50 to 150° C. to obtain an appropriate deposition rate, depending on the vaporization temperatures of organic materials.

The content of the organic material in the hybrid layer according to the present invention falls within the range of 0.020 to 25 wt % particularly in consideration of a better physical property improvement effect.

The preferable film thickness and refractive index ranges of the present invention are as follows. In this case, λ represents the wavelength of light.

| | | |
|---|---|---|
| First layer | 0.005 λ to 1.25 λ | 1.41 to 1.50 |
| Second layer | 0.005 λ to 0.10 λ | 2.00 to 2.35 |
| Third layer | 0.005 λ to 1.25 λ | 1.41 to 1.50 |
| Fourth layer | 0.05 λ to 0.45 λ | 2.00 to 2.35 |
| Fifth layer | 0.005 λ to 0.15 λ | 1.41 to 1.50 |
| Sixth layer | 0.05 λ to 0.45 λ | 2.00 to 2.35 |
| Seventh layer | 0.2 λ to 0.29 λ | 1.41 to 1.50 |

The above physical properties of the films can achieve the target physical properties.

The uppermost water-repellent film layer 67 improves the smoothness of the convex optical surface 2*a* and the concave optical surface 2*b* to improve the antifouling property and prevent water stain. A super water-repellent lens excellent in slide property is recently popular. A water-repellent agent made from an organosilicon compound containing a fluorine-substituted alkyl group is used as the water-repellent agent.

The material and formation method of the water-repellent film layer 67 preferably employ a method described in Japanese Patent Laid-Open No. 2004-122238. According to this method, the organosilicon compound containing the fluorine-substituted alkyl group diluted with a solvent is set in a reduced pressure. The process from the start of heating to the deposition is preferably finished within 90 sec and preferably 10 sec in the temperature range equal to or higher than the deposition start temperature of this organosilicon compound and not exceeding its decomposition temperature. A method which achieves this deposition time range is preferably a method which irradiates the organosilicon compound with an electron beam.

A compound represented by general formula (h) or unit formula (i) is preferably used as the organosilicon compound containing the fluorine-substituted alkyl group.

[Chemical 7]

(h)

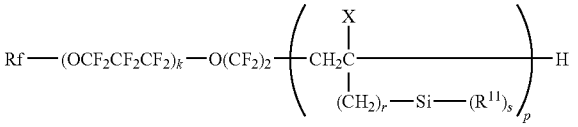

In general formula (h), RF represents a straight chain perfluoroalkyl group having 1 to 16 carbon atoms, X represents hydrogen or a lower alkyl group having 1 to 5 carbon atoms, $R^{11}$ represents a hydrolyzable group, k is an integer of 1 to 50, r is an integer of 0 to 2, and p is an integer of 1 to 10.

$$C_qF_{2q+1}CH_2CH_2Si(NH_2)_3 \quad \text{(i)}$$

wherein q is an integer of 1 or more.

Examples of the hydrolyzable group represented by $R^{11}$ include an amino group, an alkoxy group particularly an alkoxy group including an alkyl part having 1 to 2 carbon atoms, and a chlorine atom.

Specific examples of the compound represented by unit formula (i) include n-$CF_3CH_2CH_2Si(NH_2)_3$; n-trifluoro(1,1,2,2-tetrahydro)propylsilazane, n-$C_3F_7CH_2CH_2Si(NH_2)_3$; n-heptafluoro(1,1,2,2-tetrahydro)pentylsilazane, n-$C_4F_9CH_2CH_2Si(NH_2)_3$; n-nonafluoro(1,1,2,2-tetrahydro)hexylsilazane, n-$C_6F_{13}CH_2CH_2Si_2(NH_2)_3$; n-trideofluoro(1,1,2,2-tetrahydro)octylsilazane, and n-$C_8F_{17}CH_2CH_2Si(NH_2)_3$; n-heptadecafluoro(1,1,2,2-tetrahydro)decylsilazane.

The material of the water-repellent film layer 67 may contain as two major components the organosilicon compound containing the fluorine-substituted alkyl group and perfluoropolyether not containing silicon. In addition, a first layer may be formed from these major components, and a second layer may be formed on the first layer using a material containing as a major component perfluoropolyether not containing silicon, thereby forming the water-repellent film layer.

The perfluoropolyether not containing silicon preferably employs a compound consisting of a unit having the following structural formula:

$$—(R^{12}O)— \quad (j)$$

In formula (j), $R^{12}$ represents a perfluoroalkylene group having 1 to 3 carbon atoms. The average molecular weight falls within the range of 1,000 to 10,000 and more preferably 2,000 to 10,000. R represents a perfluoroalkylene group having 1 to 3 carbon atoms, and its specific examples include groups such as $CF_2$, $CF_2$—$CF_2$, $CF_2CF_2CF_2$, and $CF(CF_2)CF_2$. These perfluoropolyethers are liquid at normal temperature and called fluorine oils.

In the spectacle lens of the present invention, a layer made from at least one metal selected from metals having a catalyst function in forming a hybrid layer (to be described later), such as nickel (Ni), silver (Ag), platinum (Pt), niobium (Nb), and titanium (Ti) can be formed as an underlayer below an anti-reflection film layer in order to improve the bonding property. The most preferable underlayer is a metal layer made from niobium to impart better impact resistance. Use of the metal layer as the underlayer enhances the reaction with the hybrid layer formed on the underlayer, thereby obtaining a material having an intra-molecular network structure and improving the impact resistance.

According to the present invention, it is also preferable to form a double layer structure inside the uppermost water-repellent film layer 67, i.e., the first and second water-repellent layers. For example, a vapor material containing a mixture of the organosilicon compound containing the fluorine-substituted alkyl group represented by general formula (I) and at least one silane compound selected from the following general formulas (II-1), (II-2), and (II-3) is deposited on the optical member to form the first water-repellent layer. The resultant structure is dipped in a dipping material containing a solvent and perfluoropolyether-polysiloxane copolymer modified silane represented by general formula (III) to form the second water-repellent layer, thereby forming a water-repellent film layer 67 made from the two layers.

General Formula (I)

[Chemical 8]

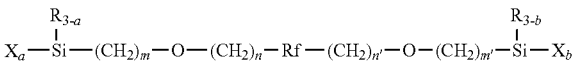

(I)

In general formula (I), Rf represents a divalent group which includes a unit represented by formula —($C_kF_{2k}O$)— (wherein k is an integer of 1 to 6) and has an unbranched straight chain perfluoropolyalkylene ether structure. R independently represents a monovalent hydrocarbon group having 1 to 8 carbon atoms. X independently represents a hydrolyzable group or halogen atom, n and n' each represent an integer of 0 to 2, m and m' each represent an integer of 1 to 5, and a and b each represent 2 or 3.

General Formula (II)

[Chemical 9]

$$R'—Si(OR'')_3 \quad \text{General formula (II-1)}$$

$$Si(OR'')_4 \quad \text{General formula (II-2)}$$

$$SiO(OR'')_3Si(OR'')_3 \quad \text{General formula (II-3)}$$

wherein R' represents an organic group and R" represents an alkyl group.

General Formula (III)

[Chemical 10]

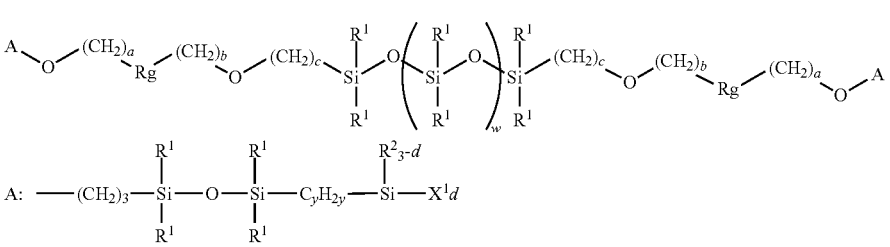

(III)

In general formula (III), Rg represents a divalent group which includes a repeating unit represented by formula —($C_jF_{2j}O$)— (wherein j is an integer of 1 to 5) and has an unbranched straight chain perfluoropolyalkylene ether structure. The repeating unit count is 30 to 60. Different j repeating units may be simultaneously included. $R^1$ represents the same or different alkyl groups or phenyl groups having 1 to 4 carbon atoms, w is 30 to 100, and a, b, and c each independently represent an integer of 1 to 5. $R^2$ represents an alkyl group or phenyl group having 1 to 4 carbon atoms, $X^1$ represents a hydrolyzable group, d is 2 or 3, and y is an integer of 1 to 5.

The compounds represented by general formulas (I) to (III) will be described below.

In general formula (I), the Rf group is a divalent group which includes a unit represented by formula —($C_kF_{2k}O$)— (wherein k is an integer of 1 to 6 and preferably 1 to 4, and the sequence of $CkF_{2k}O$ in general formula (I) is random) and has an unbranched straight chain perfluoropolyalkylene ether structure. Note that when both n and n' in general formula (I) are zero, the terminal of the Rf group bonded to the oxygen atom (O) in general formula (I) is not an oxygen atom:

wherein Rf represents a divalent straight chain perfluoropolyether group and include perfluoropolyether groups having a variety of chain lengths. Rf preferably represents a divalent straight chain perfluoropolyether having a perfluoropolyether having 1 to 6 carbon atoms as the repeating unit. Examples of this divalent straight chain perfluoropolyether are as follows:

$$—CF_2CF_2O(CF_2CF_2CF_2O)_r,CF_2CF_2—$$

$$—CF_2(OC_2F_4)_s—(OCF_2)_t—$$

wherein r, s, and t each represent an integer of 1 or more. More specifically, r, s, and t each fall within the range of 1 to 50 and more preferably 10 to 40. Note the perfluoropolyether molecular structure is not limited to the exemplified structures.

In general formula (I), X represents a hydrolyzable group or halogen atom. Examples of X as the hydrolyzable group include an alkoxy group such as a methoxy group, ethoxy group, propoxy group, or butoxy group; an alkoxyalkoxy group such as a methoxymethoxy group, methoxyethoxy group, or ethoxyethoxy group; an alkenyloxy group such as an allyloxy group or isopropenoxy group; an asiloxy group such as an acetoxy group, propyonyloxy group, butylcarbonyloxy group, or benzoyloxy group; a ketoxime group such as a dimethylketoxime group, methylethylketoxime group, diethylketoxime group, cyclopentanoxime group, or cyclohexanoxime group; an amino group such as an N-methylamino group, N-ethylamino group, N-propylamino group, N-butylamino group, N,N-dimethylamino group, N,N-diethylamino group, or N-cyclohexylamino group; an amide group such as an N-methylacetoamide group, N-ethylacetoamide group, or N-methylbenzamide group; and an aminooxy group such as an N,N-dimethylaminooxy group or N,N-diethylaminooxy group.

Examples of X as the halogen atom include a chlorine atom, bromine atom, and iodine atom.

Among them all, the methoxy group, ethoxy group, isopropenoxy group, and chlorine atom are most preferable.

In general formula (I), R represents a monovalent hydrocarbon group having 1 to 8 carbon atoms. If R represents a plurality of monovalent hydrogen groups, they may be the same or different. Specific examples of R include an alkyl group such as a methyl group, ethyl group, propyl group, butyl group, pentyl group, hexyl group, heptyl group, or octyl group; a cycloalkyl group such as a cyclopentyl group or cyclohexyl group; an aryl group such as a phenyl group, tolyl group, or xylyl group; an aralkyl group such as a benzyl group or phenetyl group; and an alkenyl group such as a vinyl group, allyl group, butenyl group, pentenyl group, or hexenyl group. Among them all, a monovalent hydrocarbon group having 1 to 3 carbon atoms is preferable, and the methyl group is most preferable.

In general formula (I), n and n' each represent an integer of 0 to 2 and preferably 1, and may be the same or different, m and m' each represent an integer of 1 to 5, preferably 3, and may be the same or different.

Next, a and b each represent 2 or 3 and preferably 3 in view of hydrolysis, condensation reactivity, and bonding property.

The molecular weight of the organosilicon compound containing the fluorine-substituted alkyl group represented by general formula (I) is not particularly limited, but its number average molecular weight appropriately falls within the range of 500 to 20,000 and preferably 1,000 to 10,000 in view of stability and handling.

Specific examples of the organosilicon compound containing the fluorine-substituted alkyl group represented by structural formula (I) are as follows, but are not limited to the exemplified compounds.

$(CH_3O)_3SiCH_2CH_2CH_2OCH_2CF_2CF_2O(CF_2CF_2CF_2O)_1CF_2CF_2CH_2OCH_2CH_2—CHSi(OCH_3)_3$ $(CH_3O)_2CH_3SiCH_2CH_2CH_2OCH_2CF_2CF_2O(CF_2CF_2CF_2O)_1CF_2CF_2CH_2OCH_2CH_2—CH_2SiCH_3(OCH_3)_2(CH_3O)_3SiCH_2CH_2CH_2OCH_2CF_2(OC_2F_4)_p(OCF_2)_qOCF_2—CH_2OCH_2CH_2CH_2Si(OCH_3)_3$ $(CH_3O)_2CH_3SiCH_2CH_2CH_2OCH_2CH_2CF_2(OC_2F_4)_p(OCF_2)_qOCF_2CH_2OCH_2CH_2—CH_2SiCH_3(OCH_3)_2$ $(CH_3O)_3SiCH_2CH_2CH_2OCH_2CH_2CF_2(OC_2F_4)_p(OCF_2)_qOCF_2CH_2OCH_2CH_2—CH_2Si(OCH_3)_3$ $(C_2H_5O)_3SiCH_2CH_2CH_2OCH_2CH_2CF_2(OC_2F_4)_p(OCF_2)_qOCF_2CH_2OCH_2CH_2CH_2—Si(OC_2H_5)_3$

The compound represented by general formula (I) can be used singly or in a combination of two or more compounds. In some case, the organosilicon compound containing the fluorine-substituted alkyl group and its partial hydrolyzed condensate can be combined and used. In addition, perfluoropolyether-polysiloxane copolymer modified silane represented by general formula (III) can be combined and used with the compound represented by general formula (I).

The organosilicon compound containing the fluorine-substituted alkyl group represented by general formula (I) is preferably diluted with a solvent. Examples of a solvent to be used include a fluorine-modified aliphatic hydrocarbon solvent (e.g., perfluoroheptane or perfluorooctane), a fluorine-modified aromatic hydrocarbon solvent (e.g., 1,3-di(trifluoromethyl)benzene or trifluoromethylbenzene), a fluorine-modified ether solvent (e.g., methylperfluorobutyl ether or perfluoro(2-butyltetrahydrofurane), a fluorine-modified alkylamine solvent (e.g., perfluorotributylamine or perfluorotripentylamine), a hydrocarbon solvent (e.g., petroleum benzene, mineral spirits, toluene, or xylene), a ketone solvent (e.g., acetone, methyl ethyl ketone, or methyl isobutyl ketone), and an alcohol solvent (methanol, ethanol, isopropanol, or n-propanol). These solvents can be used singly or in a combination of two or more solvents. Among them all, a fluorine-modified solvent is preferable in view of the dissolvability and wettability of modified silane. Examples of the most preferable solvent include 1,3-di(trifluoromethyl)benzene, perfluoro(2-butyltetrahydrofurane), and perfluorotributylamine.

One silane compound selected from the general formulas (II-1), (II-2), and (II-3) comprises the following:

$R'—Si(OR'')_3$ General formula (II-1)

$Si(OR'')_4$ General formula (II-2)

$SiO(OR'')_3Si(OR'')_3$ General formula (II-3)

wherein R' represents an organic group. Examples of R' include an alkyl group (e.g., a methyl group, ethyl group, or propyl group) having 1 to 50 carbon atoms (preferably 1 to 10 carbon atoms), an epoxyethyl group, a glycidyl group, and an amino group. These groups may be substituted. R'' represents an alkyl group (e.g., a methyl group, ethyl group, or propyl group) having 1 to 48 carbon atoms and is preferably a methyl group or ethyl group.

Specific examples of the silane compounds represented by general formulas (II-1) to (II-3) include structural formulas $(C_2H_5O)_3SiC_3H_6NH_2$, $(CH_3O)_3SiC_3H_6NH_2$, $(C_2H_5O)_4Si$, and $(C_2H_5O)_3Si—O—Si(OC_2H_5)_3$. However, the silane compound is not limited to the above examples.

The silane compounds represented by general formulas (II-1) to (II-3) can be used singly or in a combination of two or more silane compounds.

The silane compound preferably contains the compound represented by general formula (II-1) singly or in an amount larger than those of other components.

Perfluoropolyether-polysiloxane copolymer modified silane represented by general formula (III)

[Chemical 11]

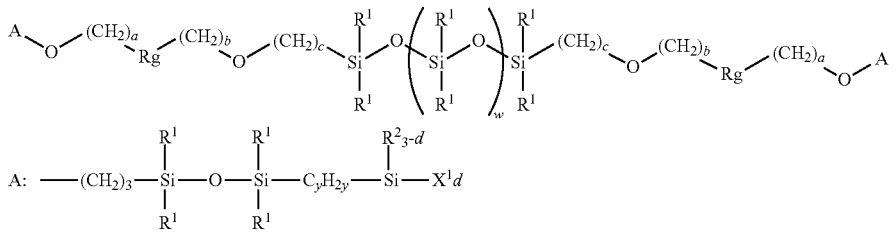

(III)

In general formula (III), the Rg group is a divalent group which includes repeating unit represented by formula —($C_jF_{2j}O$)— (wherein j is an integer of 1 to 5 and preferably 1 to 3, and the sequence of $C_jF_{2j}O$ in general formula (III) is random) and has an unbranched straight chain perfuluoropolyalkylene ether structure. The repeating unit count is 30 to 60 (preferably 30 to 50). Different j repetition counts may be simultaneously included:

wherein Rg represents a divalent straight chain perfluoropolyether group and include perfluoropolyether groups having a variety of chain lengths. Rg preferably represents a divalent straight chain perfluoropolyether having a perfluoropolyether having about 1 to 5 carbon atoms as the repeating unit. Examples of this divalent straight chain perfluoropolyether are as follows:

$$—CF_2CF_2O(CF_2CFCF_2O)_kCF_2CF_2—$$

$$—CF_2(OC_2F_4)_p—(OCF_2)_q—$$

wherein k, p, and q each represent an integer of 1 or more, and k and p+q preferably fall within the range of 30 to 60. Note the perfluoropolyether molecular structure is not limited to the exemplified structures.

In general formula (III), $R^1$ represents an alkyl group (e.g., a methyl group, ethyl group, propyl group, or butyl group) or phenyl group having 1 to 4 carbon atoms. The alkyl groups or phenyl groups may be the same or different.

In general formula (III), w is 30 to 100 and preferably 30 to 60, and a, b, and c each independently represent an integer of 1 to 5 and preferably 1 to 3.

In general formula (III), $R^2$ represents an alkyl group (e.g., a methyl group, ethyl group, propyl group, or butyl group) or phenyl group having 1 to 4 carbon atoms.

In general formula (III), $X^1$ represents a hydrolyzable group. Examples of $X^1$ include an alkoxy group such as a methoxy group, ethoxy group, propoxy group, or butoxy group; an alkoxyalkoxy group such as a methoxymethoxy group, methoxyethoxy group, or ethoxyethoxy group; alkenyloxy group such as an allyloxy group or isopropenoxy group; an acyloxy group such as an acetoxy group, propionyloxy group, butylcarbonyloxy group, or benzoyloxy group; a ketoxime group such as a dimethylketoxime group, methylethylketoxime group, diethylketoxime group, cyclopentanoxime group, or cyclohexanoxime group; an amino group such as an N-methylamino group, N-ethylamino group, N-propylamino group, N-butylamino group, N,N-dimethylamino group, N,N-diethylamino group, or N-cyclohexylamino group; an amide group such as an N-methylacetoamide group, N-ethylacetoamide group, or N-methylbenzamide group; and an aminooxy group such as an N,N-dimethylaminooxy group or N,N-diethylaminooxy group. Among them all, the methoxy group, ethoxy group, and isopropynoxy group are preferable.

In general formula (III), d is 2 or 3 and preferably 3 in consideration of hydrolysis, condensation reactivity, and film bonding property, and y is an integer of 1 to 5 and preferably 1 to 3.

The compounds represented by general formula (III) can be used singly or in a combination of two or more compounds.

The material of the plastic base member used in the present invention is not limited to a specific material. Examples of the plastic base member include a methyl methacrylate homopolymer, a copolymer formed from methyl methacrylate and at least another monomer, a homopolymer made from diethylene glycol bisallylcarbonate, a copolymer formed from diethylene glycol bis(allyl carbonate) and at least another monomer, a sulfur-containing copolymer, a halogen copolymer, and a polymer using as a material a compound including polycarbonate, polystyrene, polyvinyl chloride, unsaturated polyester, polyethylene terephtalate, polyurethane, polythiourethane, or epithio group.

Examples of the compound having the epithio group include chain organic compounds such as bis(β-epithiopropylthio)metane, 1,2-bis(β-epithiopropylthio)ethane, 1,3-bis(β-epithiopropylthio)propane, 1-2-(β-epithiopropylthio)propane, 1-(β-epithiopropylthio)-2-(β-epithiopropylthio)propane, 1,4-bis(β-epithiopropylthio)butane, 1,3-bis(β-epithiopropylthio)butane, 1-(β-epithiopropylthio)-3-(β-epithiopropylthiomethyl)butane, 1,5-bis(β-epithiopropylthio)pentane, 1-(β-epithiopropylthio)-4-(β-epithiopropylthiomethyl)pentane, 1,6-bis(β-epithiopropylthio)hexane, 1-(β-epithiopropylthio)-5-(β-epithiopropylthiomethyl)hexane, 1-(β-epithiopropylthio)-2-[(2-β-epithiopropylthioethyl)thio]ethane, and 1-(β-epithiopropylthio)-2-[[2-(2-β-epithiopropylthioethyl)thioethyl]thio]ethane. Examples of the compound having the epithio group also include branched organic compounds and compounds obtained by substituting at least one hydrogen of the episulfide group of each of these compounds with a methyl group. Specific examples of the branched organic compounds include tetrakis(β-epithiopropylthiomethyl)methane, 1,1,1-tris(β-epithiopropylthiomethyl)propane, 1,5-bis(β-epithiopropylthio)-2-(β-epithiopropylthiomethyl)-3-thiapentane, 1,5-bis(β-epithiopropylthio)-2,4-bis(β-epithiopropylthiomethyl)-3-thiopentane, 1-(β-epithiopropylthio)-2,2-bis(β-epithiopropylthiomethyl)-4-thiahexane, 1,5,6-tris(β-epithiopropylthio)-4-(β-epithiopropylthiomethyl)-3-thiahexane, 1,8-bis(β-epithiopropylthio)-4-(β-epithiopropylthiomethyl)-3,6-dithiaoctane, 1,8-bis(β-epithiopropylthio)-4,5-bis(β-epithiopropylthiomethyl)-3,6-dithiaoctane, 1,8-bis(β-epithiopropylthio)-4,4-bis(β-epithiopropylthiomethyl)-3,6-dithiaoctane, 1,8-bis(β-epithiopropylthio)-2,4,5-tris(β-epithiopropylthiomethyl)-3,6-dithiaoctane, 1,8-bis(β-epithiopropylthio)-2,5-bis(β-epithiopropylthiomethyl)-3,6-dithiaoctane, 1,9-bis(β-epithiopropylthio)-5-(β-epithiopropylthiomethyl)-5-[(2-β-epithiopropylthioethyl) thiomethyl]-3,7-dithianonane, 1,10-bis(β-epithiopropylthio)-5,6-bis[(2-(β-epithiopropylthioethyl) thio]-3,6,9-trithiadecane, 1,11-bis(β-epithiopropylthio)-4,8-bis(β-epithiopropylthiomethyl)-3,6,9-trithiaundecane, 1,11-bis(β-epithiopropylthio)-5,7-bis(β-epithiopropylthiomethyl)-3,6,9-trithiaundecane, 1,11-bis(β-epithiopropylthio)-5,7-[(2-(β-epithiopropylthioethyl) thiomethyl]-3,6,9-trithiaundecane, and 1,11-bis(β-epithiopropylthio)-4,7-bis(β-epithiopropylthiomethyl)-3,6,9-trithiaundecane. Examples of the compound having the epithio group further include alicyclic organic compounds and compounds obtained by substituting at least one hydrogen of the episulfide group of each of these compounds with a methyl group, and aromatic organic compounds and compounds obtained by substituting at least one hydrogen of the episulfide group of each of these compounds with a methyl group. Specific examples of the alicyclic organic compound include 1,3- and 1,4-bis(β-epithiopropylthio)cyclohexane, 1,3- and 1,4-bis(β-epithiopropylthiomethyl)cyclohexane, bis[4-(β-epithiopropylthio)cyclohexyl]methane, 2,2-bis[4-(β-epithiopropylthio)cyclohexyl]propane, bis[4-(β-epithiopropylthio)cyclohexyl]sulfide, 2,5-bis(β-epithiopropylthiomethyl)-1,4-dithiane, and 2,5-bis(β-epithiopropylthioethylthiomethyl)-1,4-dithiane. Specific examples of the aromatic organic compound include 1,3- and 1,4-bis(β-epithiopropylthio)benzene, 1,3- and 1,4-bis(β-epithiopropylthiomethyl)benzene, bis[4-(β-epithiopropylthio) phenyl]methane, 2,2-bis[4-(β-epithiopropylthio)phenyl]propane, bis[4-(β-epithiopropylthio)phenyl]sulfide, bis[4-(β-epithiopropylthio)phenyl)sulfone, and 4,4'-bis(β-epithiopropylthio)biphenyl.

Figure 2:
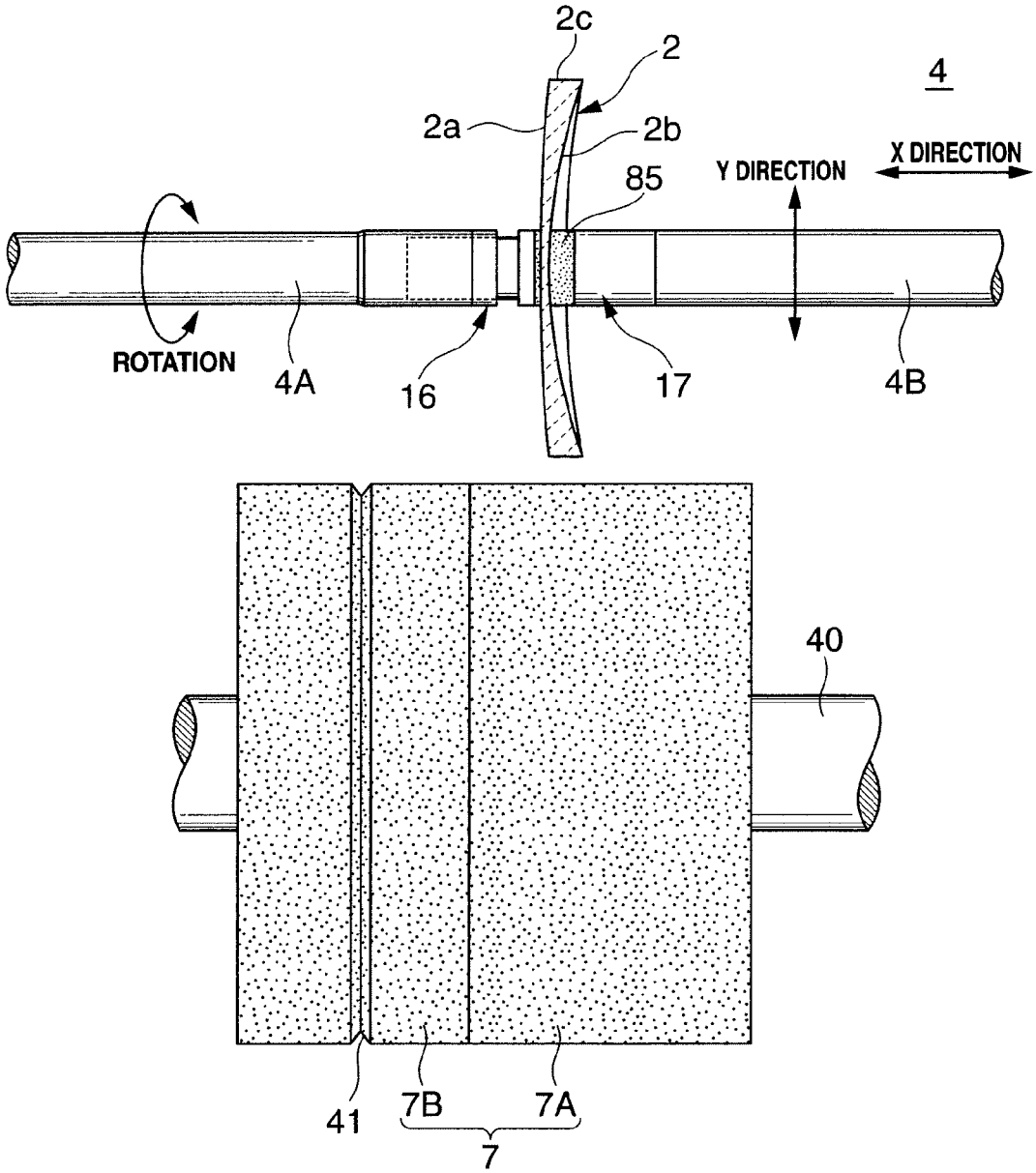
FIG. 2 is a view showing a state in which a processing target lens is mounted on a lens rotating shaft.
Figure 4:
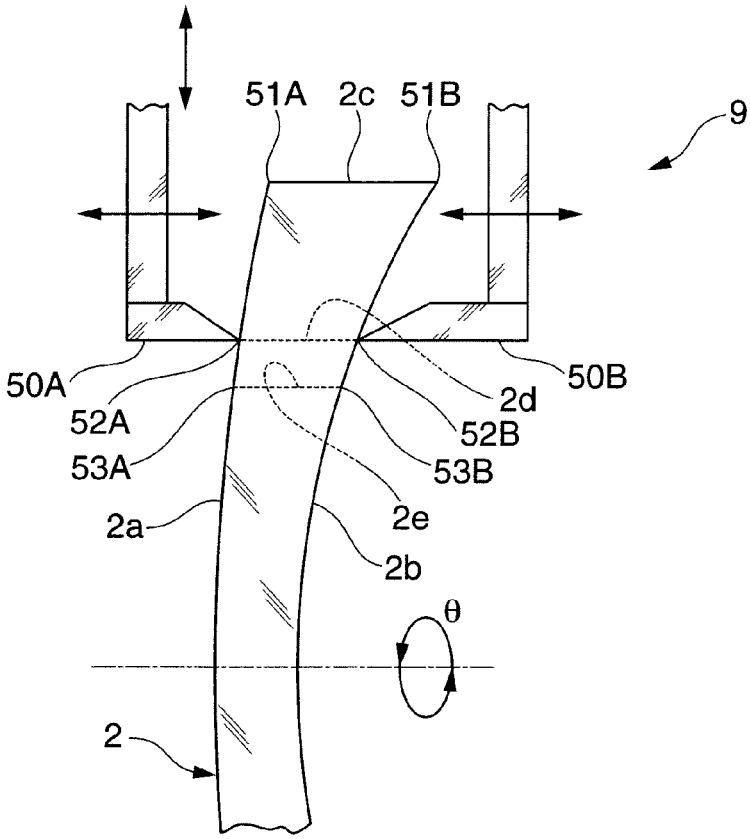
FIG. 4 is a view showing how a lens shape measurement unit measures the lens shape.

Referring to FIGS. 1 and 4, the lens rotating shaft 4 includes first and second lens rotating shafts 4A and 4B arranged horizontally such that their axes coincide with each other, and is disposed in a lens holding unit 15. The lens holding unit 15 has a pair of supports 15*a* and 15*b* opposing each other in the horizontal direction (X direction) of the apparatus. One support 15*a* axially, rotatably supports the first lens rotating shaft 4A, and the other support 15*b* axially supports the second lens rotating shaft 4B to be rotatable and movable in the axial direction. As shown in FIG. 2, a lens holder 16 and lens retainer 17 constituting the lens holding means for the processing target lens 2 are detachably attached to the opposing distal ends of the first and second lens rotating shafts 4A and 4B, respectively.

A lens rotating shaft driving motor 18 is fixed to the other support 15*b* of the lens holding unit 15. The rotation of the driving motor 18 is transmitted to the first and second lens rotating shafts 4A and 4B through a rotation transmitting means 19 such as a pulley or toothed belt. Therefore, the first and second lens rotating shafts 4A and 4B are synchronously driven. As the lens rotating shaft driving motor 18, a reversible pulse motor with a variable rotation speed is used. A driving motor (not shown) which moves the second lens rotating shaft 4B forward/backward with respect to the first lens rotating shaft 4A is built in the other support 15*b* of the lens holding unit 15.

The first lens rotating shaft moving mechanism 5 includes a pair of front and rear X-axis linear guides 31, an X-direction table 32, and an X-direction table driving motor 33. The X-axis linear guides 31 are set on a bottom plate 30 of the housing 3 to be parallel to each other and are long in the X direction. The X-direction table 32 is movable in the X direction along the X-axis linear guides 31. The X-direction table driving motor 33 moves the X-direction table 32 along the X-axis linear guides 31.

The second lens rotating shaft moving mechanism 6 includes a pair of left and right Y-axis linear guides 35, a Y-direction table 36, a Y-direction table driving motor 37, and the lens holding unit 15. The Y-axis linear guides 35 are set on the upper surface of the X-direction table 32 to be parallel to each other and extend in the Y direction. The Y-direction table 36 is movable in the Y direction along the Y-axis linear guides 35. The Y-direction table driving motor 37 moves the Y-direction table 36 along the Y-axis linear guides 35. The lens holding unit 15 is set on the Y-direction table 36. Thus, the operation of the lens rotating shaft 4 includes movements in three directions, i.e., rotation about the axis, movement in the horizontal direction (X direction) perpendicular to the axis, and movement in the back-and-forth direction (Y direction). The controller numerically controls the movements in the three directions based on the shape processing data on the processing target lens 2.

As the processing tool 7 which grinds a circumferential surface 2*c* of the processing target lens 2, a grinding stone such as a cylindrical diamond wheel as shown in FIG. 2 is employed and attached to a processing tool rotating shaft 40 of the rotational drive mechanism 8. The processing tool 7 includes a primary processing (rough processing) grinding wheel 7A and secondary processing (finishing) grinding wheel 7B. A beveling groove 41 formed of an axi-symmetric V-shaped annular groove is formed in the outer circumferential surface of the secondary processing grinding wheel 7B.

The rotational drive mechanism 8 of the processing tool 7 includes a frame 44, the processing tool rotating shaft 40, an inverter type processing tool driving motor 45, and a rotation transmitting mechanism 46 such as a pulley or toothed belt. The frame 44 is set on the bottom plate 30 of the housing 3. The processing tool rotating shaft 40 is cantilevered at the upper end of the frame 44. The processing tool driving motor 45 rotates the processing tool rotating shaft 40. The rotation transmitting mechanism 46 transmits the rotation of the processing tool driving motor 45 to the processing tool rotating shaft 40. The processing tool rotating shaft 40 is parallel to the lens rotating shaft 4 and located in front of it.

As shown in FIG. 4, the lens shape measurement unit 9 includes a pair of left and right measurement elements 50A and 50B, a driving motor (not shown), and an arithmetic processing unit (not shown). The measurement elements 50A and 50B are disposed to oppose each other and trace the optical surfaces 2*a* and 2*b* of the processing target lens 2. The driving motor moves the measurement elements 50A and 50B to be close to and separate from each other. The arithmetic processing unit calculates the positions of the optical surfaces 2*a* and 2*b* and those of the two edges of each of the circumferential surface 2*c* and circumferential surfaces 2*d* and 2*e*, i.e., convex peripheral edges 51A, 52A, and 53A and concave peripheral edges 51B, 52B, and 53B, of the processing target lens 2 from the traces of the measurement elements 50A and 50B, and measures shape information on the processing target lens 2. In FIG. 4, reference numeral 2*c* denotes the circumferential surface of the processing target lens 2 before edging; 2*d*, the circumferential surface after primary processing; and 2*d*, the circumferential surface after secondary processing.

When measuring the shape of the processing target lens 2 by the lens shape measurement unit 9, the processing target lens 2 is rotated. The left and right measurement elements 50A and 50B are moved close to each other and urged against the optical surfaces 2*a* and 2*b*, respectively, of the processing target lens 2. In this state, the lens holding unit 15 is moved back and forth. Then, the shape of the processing target lens 2 can be measured.

The chamfering mechanism 10 chamfers the edge portions 53A and 53B of the processing target lens 2 after secondary processing, and includes a pair of left and right chamfering tools 60, a chamfering driving motor 61, and a rotation transmitting mechanism 62 such as a pulley or belt. The chamfering driving motor 61 drives the chamfering tools 60. The rotation transmitting mechanism 62 transmits the rotation of the chamfering driving motor 61 to the chamfering tools 60. As the chamfering tools 60, grinding tools such as diamond wheels are employed.

Figure 7:
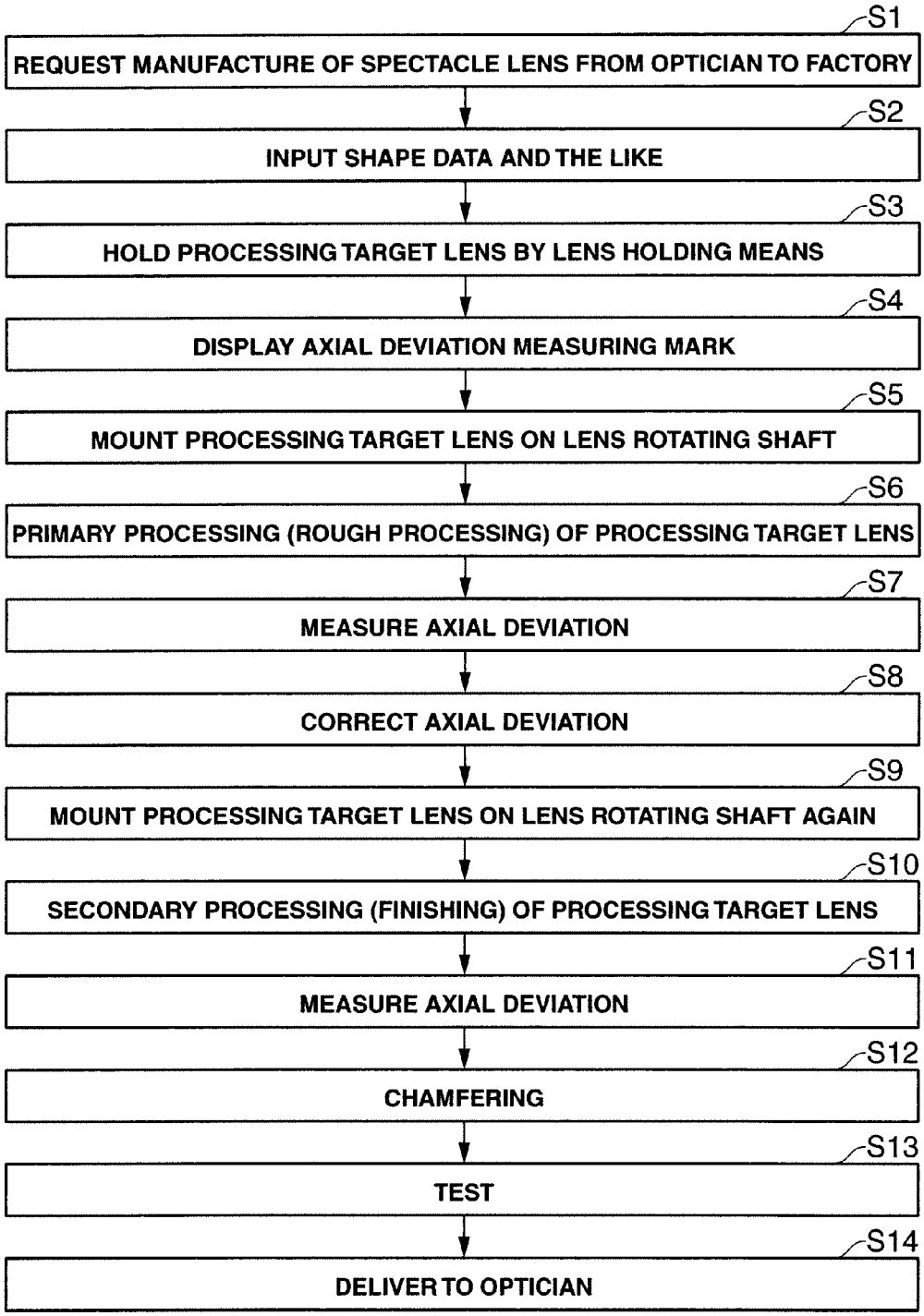
FIG. 7 is a flowchart of edging.

The procedure of edging the processing target lens 2 by the spectacle lens edging apparatus 1 having the above structure will be described based on the flowchart shown in FIG. 7.

First, the optician as the order placing side transmits information on a spectacle lens needed by the manufacturer to the lens manufacturer's factory as the manufacturing side in an online manner (step S1). When requesting manufacture and delivery of the lens to the factory, the optician sends to the factory various types of information such as the material and prescription values of the lens, the specified processing values of the lens, spectacle frame information, layout information which specifies the eye point position, the bevel mode, the bevel position, and the bevel shape that are necessary for the lens manufacture. The spectacle frame information includes 3-dimensional lens frame shape data, approximate curved surface definition data, a frame PD (or DBL), an optical axis angle, and the circumferential length.

This request for manufacturing the spectacle lens from the optician to the factory is effective particularly when, e.g., requesting the manufacture of a lens having a water-repellent film layer (because primary processing by the optician is difficult if a water-repellent film layer is formed on the lens).

At the factory, upon acquiring various types of information necessary for the manufacture of the spectacle lens from the optician, processing shape data, edged lens shape information, layout information, processing designation information and the like are created based on the acquired information, and input to the edging apparatus 1 (step S2).

Subsequently, the operator selects among uncut lenses stored as the stock a lens complying with the ordered lens as the processing target lens 2 and holds the optical surface 2*a* of the selected lens 2 using the lens holder 16 (step S3).

Figure 3:
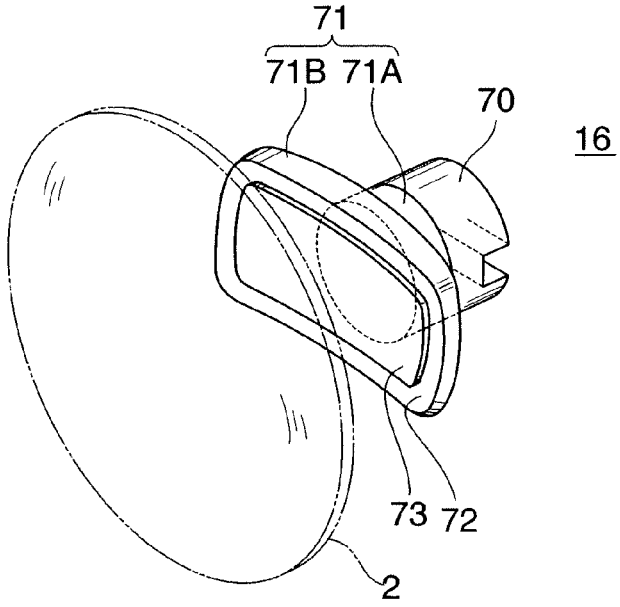
FIG. 3 is a perspective view showing how a lens holder is mounted on the processing target lens.
Figure 5A:
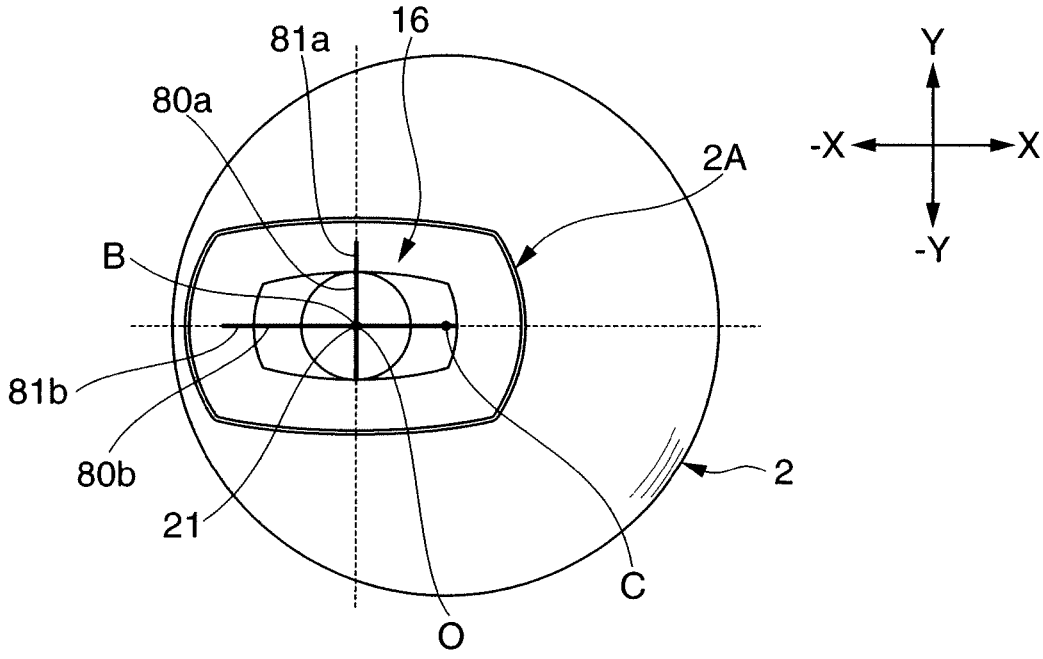
FIG. 5A is a view showing a state in which the lens holder is mounted on the processing target lens.

As shown in FIG. 3, the lens holder 16 includes a metal shaft portion 70 and a holding cup 71 which is integrally molded with the shaft portion 70 and made of an elastic material. The holding cup 71 includes a shaft portion 71A fixed to the shaft portion 70 and a lens holding portion 71B integrally provided to the distal end face of the shaft portion 71A. The lens holding portion 71B forms a rectangular plate. The front surface of the lens holding portion 71B forms a lens holding surface 72. The lens holding surface 72 forms a concave surface with a radius of curvature almost equal to that of the convex optical surface 2*a* of the lens 2. A leap tape 73 is adhered to the lens holding surface 72. When holding the processing target lens 2 using the lens holder 16, the leap tape 73 may be adhered to the convex optical surface 2*a* by urging. At this time, the lens holder 16 is attached to the processing target lens 2 such that its center O coincides with a processing center position 21 serving as the rotation center of the processing target lens 2 when processing the processing target lens 2, as shown in FIG. 5A. If the lens includes a cylinder axis, the lens holder 16 is attached to the lens by setting the cylinder axis at a predetermined angle. The processing center position 21 of the processing target lens 2 coincides with a frame center B of the spectacle frame, or an optical center C of the processing target lens 2.

The operator displays two axial deviation measuring marks 81*a* and 81*b* (FIGS. 5A to 5C) on the convex optical surface 2*a* of the processing target lens 2 (step S4). Two reference position marks 80*a* and 80*b* are displayed on the lens holder 16 in advance, and the axial deviation measuring marks 81*a* and 81*b* are displayed to coincide with the marks 80*a* and 80*b*. The reference position marks 80*a* and 80*b* of the lens holder 16 include two perpendicular straight lines extending through the center O and are displayed on the rear surface of the lens holding portion 71B. The reference position marks 80*a* and 80*b* are displayed on the lens holder 16 in advance before the processing target lens 2 is held. However, the present invention is not limited to this. The reference position marks 80*a* and 80*b* and axial deviation measuring marks 81*a* and 81*b* may be simultaneously displayed on the lens holder 16 and processing target lens 2 after the processing target lens 2 is held.

The axial deviation measuring marks 81*a* and 81*b* of the processing target lens 2 include two perpendicular straight lines extending through the processing center position 21. After the lens holder 16 holds the lens 2, the axial deviation measuring marks 81*a* and 81*b* are displayed using an appropriate ink such that they form straight lines continuous with the reference position marks 80*a* and 80*b*. The marks 81*a* and 81*b* have different line widths. One mark 81*a* has a larger line width than that of the other mark 81*b*.

The processing target lens 2 is mounted on the lens rotating shaft 4 (step S5). When mounting the processing target lens 2 on the lens rotating shaft 4, first, the lens holder 16 which holds the processing target lens 2 is mounted on the first lens rotating shaft 4A. The lens holder 16 can be mounted by fitting the shaft portion 70 in a recess formed in the distal end face of the first lens rotating shaft 4A.

Subsequently, the second lens rotating shaft 4B is moved forward to urge the lens retainer 17 attached to the distal end of the lens rotating shaft against the concave optical surface 2*b* of the processing target lens 2 through an elastic member 85 (FIG. 2). Thus, the lens holder 16 and lens retainer 17 sandwich and hold the processing center positions 21 of the convex and concave optical surfaces 2*a* and 2*b* of the processing target lens 2, thus completely mounting the lens on the lens rotating shaft 4.

Then, the lens rotating shaft 4 is rotated at a low speed, and the circumferential surface 2*c* of the processing target lens 2 undergoes primary processing by the processing tool 7 based on the processing shape data (step S6). In primary processing, the primary processing grinding wheel 7A grinds the circumferential surface 2*c* to form the processing target lens 2 into a primary shape. The primary shape of the processing target lens 2 obtained by primary processing is either a circle larger than a circle inscribed by the edged lens shape 2A (FIGS. 5A to 5C) that complies with the frame shape of the spectacle frame, or an edged shape similar to the edged lens shape 2A and larger than it by the processing margin of secondary processing. A circle 88 larger than the circle inscribed by the edged lens shape 2A is a circle having a radius (e.g., 50 mm) equal to or slightly larger than a value obtained by adding the processing margin of secondary processing to a maximum radius R (FIG. 5B) of the edged lens shape 2A.

When primary processing of the processing target lens 2 is ended, the operator removes it from the lens rotating shaft 4 and measures its axial deviation (step S7). Assume that the processing target lens 2 has a water-repellent film layer. If the processing target lens 2 undergoes primary processing while it is held by a lens holding force almost equal to that for a general lens, as the processing resistance is large, axial deviation occurs easily. If secondary processing is performed with the axial deviation uncorrected, the lens becomes defective.

In view of this, after primary processing is ended, the lens holder 16 is removed from the first lens rotating shaft 4A, and whether axial deviation exists or not is checked from the reference position marks 80*a* and 80*b* and axial deviation measuring marks 81*a* and 81*b*.

Figure 5B:
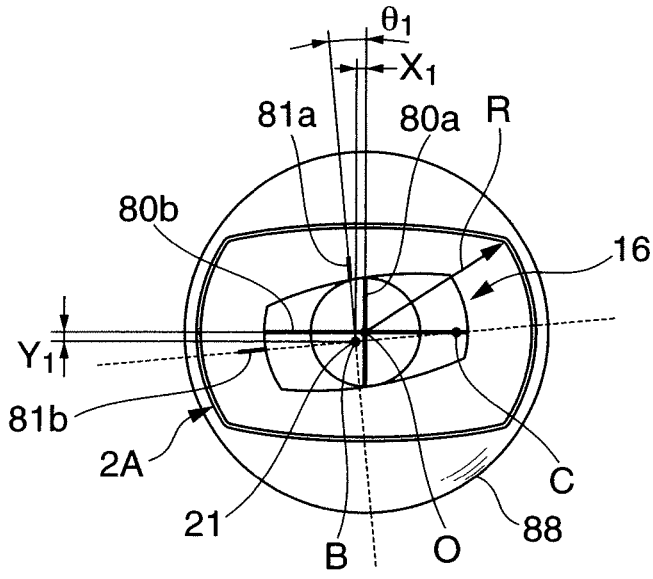
FIG. 5B is a view showing axial deviation and rotation angle deviation.
Figure 5C:
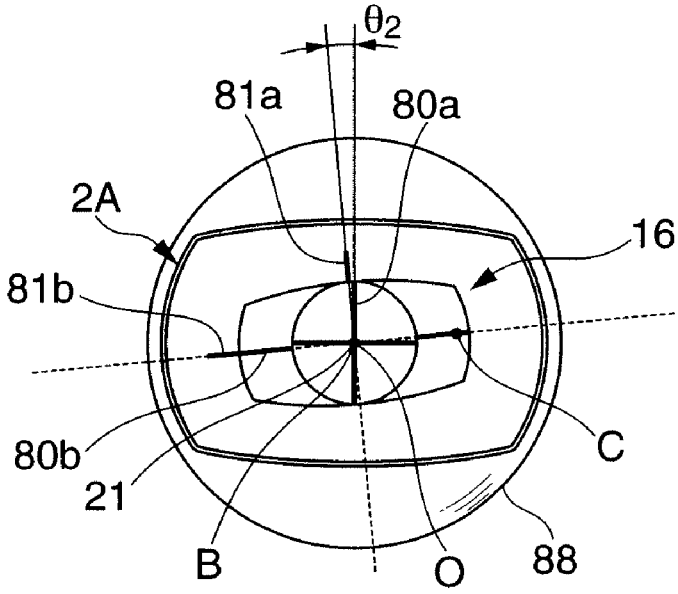
FIG. 5C is a view showing rotation angle deviation.

FIG. 5B shows a case in which, as the result of primary processing, the processing center position 21 axially deviates from the center O of the lens holder 16 by $-X_1$ in the X direction and by $-Y_1$ in the Y direction and the rotation angle axially deviates counterclockwise by $-\theta_1$ with respect to the reference position mark 80*a*. FIG. 5C shows a case in which the processing center position 21 does not axially deviate with respect to the center O of the lens holder 16 and only the rotation angle axially deviates counterclockwise by $\theta_2$ with respect to the reference position mark 80*a*.

When axial deviation exists, the deviation amounts $X_1$ and $Y_1$ in the X and Y directions of the processing center position 21 with respect to the center O of the lens holder 16, and the rotation angle $\theta_1$ or $\theta_2$ are measured. As the result of axial deviation measurement, if the deviation amounts of the processing center position 21 in the X and Y directions are ±0.5 mm or more, or if the rotation angle is ±5° or more, it is determined that the processing center position 21 axially deviates. Otherwise, it is determined that axial deviation does not exist. The allowable values of the axial deviation amounts and rotation angle differ depending on the type and dioptric power of the lens. For example, when the target lens is a single-vision lens having a cylinder axis, if the deviation of the rotation angle described above is ±2° or less, the specifications of the spectacle lens may be satisfied. The tolerance is accordingly selected appropriately.

This axial deviation measurement is performed by the operator visually, or by known image processing. When image processing is employed, it is advantageous because the deviation amount can be measured more accurately than by visual measurement. Correction of processing shape data by means of image processing will further be described later.

As the result of measurement, when it is determined that axial deviation exists, the processing target lens 2 is held again by the lens holder 16, and the axial deviation is corrected (in step S8). More specifically, the lens holder 16 is removed from the processing target lens 2. The lens holder 16 is then mounted again on the processing target lens 2 such that the center O of the lens holder 16 coincides with the processing center position 21 of the processing target lens 2 and that the reference position marks 80*a* and 80*b* coincide with the axial deviation measuring marks 81*a* and 81*b*. This corrects the axial deviation. If the axial deviation is equal to or less than the allowable value, the lens holder 16 need not be removed from the processing target lens 2.

Subsequently, the processing target lens 2 is mounted on the lens rotating shaft 4 again in accordance with the same procedure as in step S5 described above (step S9).

After the processing target lens 2 is mounted on the lens rotating shaft 4, the lens rotating shaft 4 is rotated, and the circumferential surface 2*d* of the processing target lens 2 that has been primarily processed undergoes secondary processing by the secondary processing grinding wheel 7B into a secondary shape based on the processing shape data (step S10). The secondary shape of the processing target lens 2 by secondary processing is an edged lens shape that complies with the edged lens shape 2A of the spectacle frame, or an edged lens shape slightly larger than this. The edged lens shape slightly larger than that of the spectacle frame is aimed at reserving, based on the order from the optician, a processing margin necessary when the optician performs finishing. The secondary shape of the processing target lens by secondary processing is calculated in advance in the same manner as the primary shape and input to the controller as processing shape data.

This embodiment employs the grinding wheel 7B having the beveling groove 41, because it is aimed at the manufacture of a spectacle lens to be mounted on a general rimmed spectacle frame. When manufacturing a spectacle lens to be mounted on a spectacle frame not having a rim (rimless spectacle) or a spectacle lens to be mounted on a nylol frame, the circumferential surface of the processing target lens 2 may be edged by exchanging the grinding wheel 7B for a grinding wheel for a rimless spectacle frame or nylol frame.

When secondary processing is ended, the processing target lens 2 is removed from the lens rotating shaft 4, and its axial deviation is measured (step S11). The axial deviation is determined in accordance with whether or not the reference position marks 80*a* and 80*b* deviate from the axial deviation measuring marks 81*a* and 81*b* in the same manner as in step S7 described above. In secondary processing, the processing target lens 2 which has undergone primary processing and thus has a small diameter is to be processed. Therefore, even if the lens has a low processing resistance and is formed with a water-repellent film layer, axial deviation rarely occurs, or can be suppressed within the predetermined allowable value range. Thus, highly accurate processing can be performed. When the operator visually confirms that the axial deviation measuring marks 81*a* and 81*b* do not deviate from the reference position marks 80*a* and 80*b*, it can guarantee that the processing target lens 2 is free from axial deviation.

When secondary processing is ended, chamfering is performed (step S12). Chamfering is performed by rotating the processing target lens 2 together with the lens rotating shaft 4 and urging the chamfering tools 60 against the edge portions 53A and 53B of the circumferential surface 2*e*. The chamfering trace data of the chamfering tools 60 which are used as the control data of the chamfering tools 60 during chamfering are calculated based on position data of the edge portions 53A and 53B of the circumferential surface 2*e* of the processing target lens 2 which are calculated after secondary processing.

When chamfering is ended, the processing target lens 2 is removed from the lens rotating shaft 4, and optical performance and appearance test is performed (step S13).

A processing target lens 2 determined as an acceptable product is packaged as a spectacle lens and delivered to the optician who placed the order (step S14).

Upon reception of the spectacle lens from the factory, the optician tests its optical performance and appearance. When the optician determines that the spectacle lens is appropriate, if the spectacle lens has an edged lens shape complying with the frame shape of the spectacle frame selected by the user, the optician fits the lens in the spectacle frame and delivers the spectacle frame to the user. If the spectacle lens has an edged lens shape slightly larger than the frame shape of the spectacle frame, the optician finishes the lens so as to comply with the frame shape of the spectacle lens and fits it in the spectacle frame, and delivers the spectacle frame to the user. In finishing by the optician, since the shape of the lens itself is small and accordingly the processing resistance is low, even if the lens is formed with a water-repellent film layer, the lens rarely deviates axially.

In this manner, in this embodiment, the step of correcting the axial deviation of the processing target lens includes the axial deviation measuring step of removing the processing target lens from the lens rotating shaft together with the lens holding means after primary processing and measuring the axial deviation of the processing target lens from the reference position mark and the axial deviation measuring mark, the axial deviation correcting step of correcting the axial deviation of the processing target lens which is measured by the axial deviation measuring step by holding one optical surface of the processing target lens with the lens holding means again such that the axial deviation measuring mark coincides with the reference position mark, and the step of mounting the lens holding means on the lens rotating shaft again together with the processing target lens. Thus, in secondary processing, the lens can be processed without causing axial deviation, in the same manner as a general lens. More specifically, this embodiment allows axial deviation of the processing target lens 2 in primary processing. If the processing target lens 2 axially deviates due to primary processing, the amount and direction of the axial deviation are measured, and the axial deviation is corrected by holding the processing target lens 2 again by the lens holder 16. When the axial deviation of the processing target lens 2 is corrected in this manner in secondary processing, since the shape of the lens itself in secondary processing is small, even when the lens has a water-repellent film layer, the axial deviation amount can be suppressed within the allowable value range without holding the lens with a particularly large lens holding force. Hence, even when the processing target lens 2 is a highly lubricant lens or an uncut lens having a large diameter in primary processing, no particular axial deviation preventive countermeasure is needed in the primary processing step. Such a lens can be processed highly accurately without causing axial deviation in the same manner as a general lens, even if the lens is not held with a particularly large lens holding force.

Figure 8:
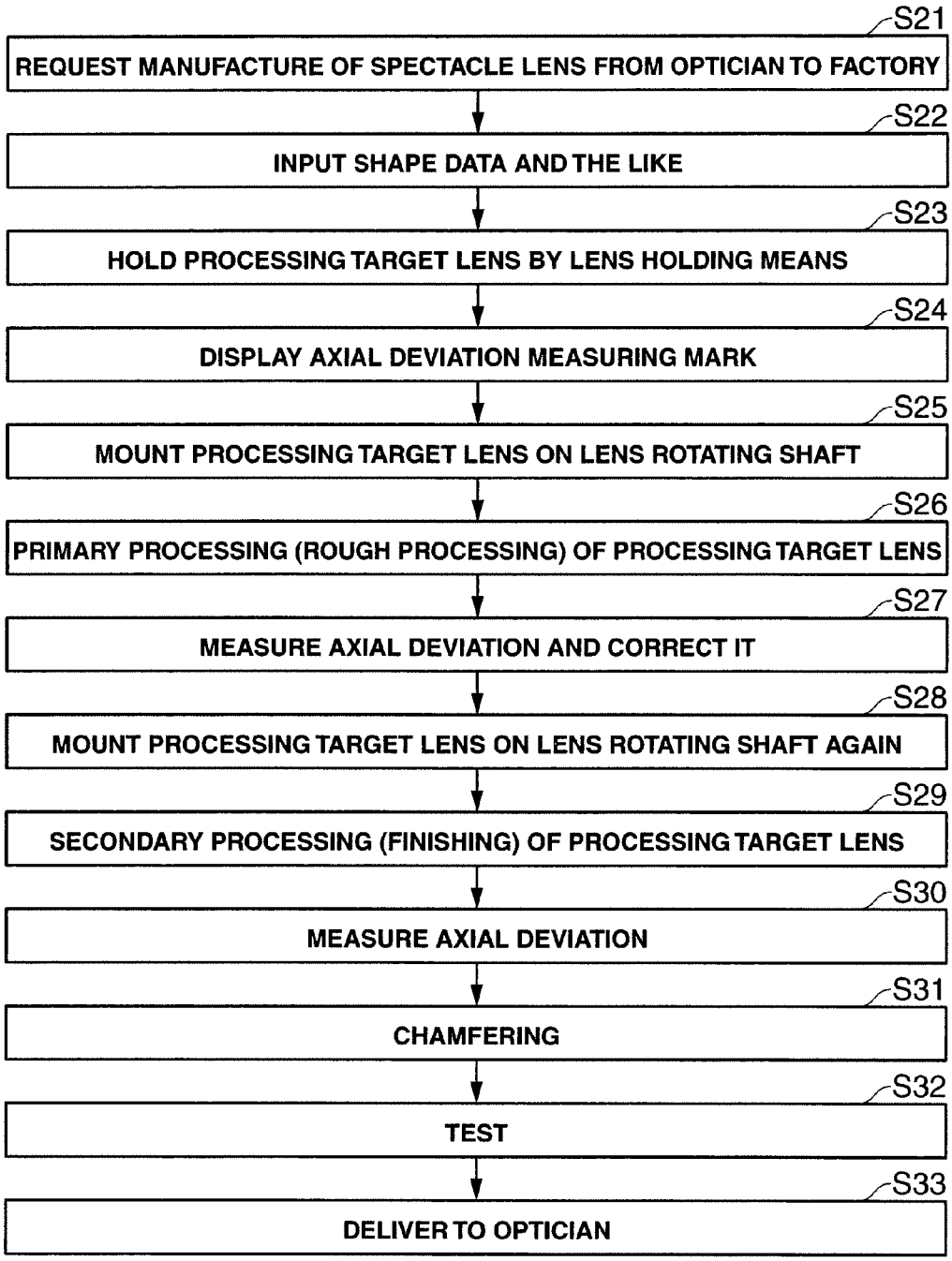
FIG. 8 is a flowchart of edging according to another embodiment of the present invention.

FIG. 8 is a flowchart showing another embodiment of the present invention.

This embodiment is different from the embodiment described above in terms of how axial deviation is corrected. More specifically, according to the measurement and correction of axial deviation in this embodiment (step S27), axial deviation is measured by image processing, and the processing shape data itself of an edging apparatus 1 is corrected.

The procedure for this will be described hereinafter.

Figure 9:
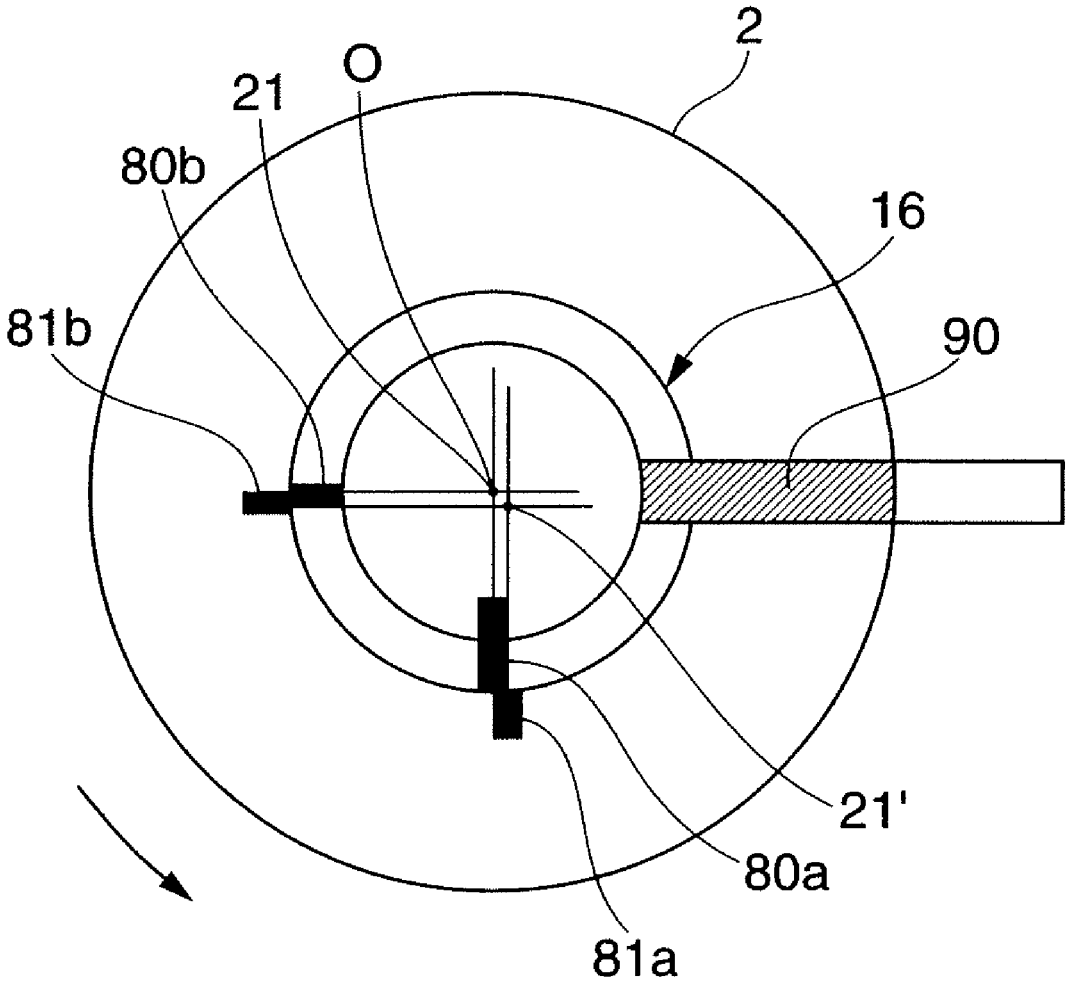
FIG. 9 is a view showing how to measure the axial deviation of a processing target lens.

When measuring axial deviation by image processing, a line sensor 90 is arranged on a straight line extending through a center O of a lens holder 16, as shown in FIG. 9. At least two reference position marks 80*a* and 80*b* and axial deviation measuring marks 81*a* and 81*b* having different line widths are displayed on the lens holder 16 and a processing target lens 2 in advance to coincide with each other. When the marks 80*a* and 80*b* and 81*a* and 81*b* have different line widths, the layout of the optical center (C) on the processing target lens 2 in the mounted state can be discriminated in the vertical and horizontal directions and the like.

When primary processing is ended, the processing target lens 2 is removed from a lens rotating shaft 4 together with the lens holder 16, and the line sensor 90 obtains the images of the reference position marks 80*a* and 80*b* and axial deviation measuring marks 81*a* and 81*b*. In obtaining the images, the coordinate values of the reference position marks 80*a* and 80*b* and axial deviation measuring marks 81*a* and 81*b* are read by rotating the processing target lens 2 in the direction of the arrow. If the marks deviate, the deviation amounts are calculated; if do not, the processing target lens 2 is mounted on the lens rotating shaft 4 again and undergoes secondary processing.

When calculating the axial deviation amounts, the reference position is determined on the center O of the lens holder 16 of a case in which the marks do not deviate. In other words, the reference position is determined on a position where straight lines extending from the two reference position marks 80*a* and 80*b* of the lens holder 16 intersect. The coordinate values of a point 21' where the straight lines extending from the axial deviation measuring marks 81*a* and 81*b* on the processing target lens 2 intersect are calculated, and the processing center position on the processing target lens 2 resulted from the axial deviation is specified (to be referred to as the processing center position 21' hereinafter).

Subsequently, as the deviation amount in a direction perpendicular to the lens rotating shaft 4, the distance and direction to the processing center position 21' with reference to the center O of the lens holder 16 are calculated and determined as a correction value A (X, Y). The processing center position of the edging apparatus 1 expressed by the correction value A is determined as the processing center 21' on the processing target lens 2 deviating from the center O of the lens holder 16. As the deviation amount in the rotational direction, angles formed by the respective axial deviation measuring marks 81*a* and 81*b* and reference position marks 80*a* and 80*b* are calculated and determined as a correction value B. The processing center of the processing shape data is corrected based on the correction value A and correction value B, and secondary processing is performed.

In this manner, after the axial deviation of the processing target lens 2 is measured by image processing, the processing shaft center of the processing shape data itself of the processing target lens 2 is corrected, and secondary processing is performed based on the corrected processing shape data. Then, even if the processing target lens 2 actually, axially deviates, it need not be removed from the lens holder 16 and held again by it. Thus, a fewer number of operation steps are required than in the embodiment described above, and the time necessary for edging can be shortened greatly, which is advantageous. Steps S21 to S26 and steps S28 to S33 are completely the same as steps S1 to S6 and steps S9 to S14 shown in FIG. 7, and a repetitive description thereof will be omitted.

In this manner, according to this embodiment, the step of correcting the axial deviation of the processing target lens comprises the step of removing the processing target lens from the lens rotating shaft together with the lens holding means after primary processing, measuring the axial deviation of the processing target lens from the reference position mark and the axial deviation measuring mark, and correcting the processing shape data. In the secondary processing step, the processing target lens is processed based on the processing shape data corrected by the processing shape data correcting step. That is, the processing shape data itself is corrected in accordance with the measured axial deviation amount and its direction. Therefore, even when the processing target lens axially deviates from the lens holding means, the lens need not be removed from the lens holding means and held again by it, and can undergo secondary processing in the axially deviating state. As a result, the step of holding the lens again by the lens holding means to correct axial deviation is not needed, and the time needed for lens edging can be shortened.

According to this embodiment, the primary shape of the processing target lens processed by the primary processing step is either one of a circle larger than a circle inscribed by the edged lens shape that complies with the frame shape of the spectacle frame and an edged shape similar to this edged lens shape and larger than this. The secondary shape of the processing target lens processed by the secondary processing step is either one of an edged lens shape that complies with the frame shape of the spectacle frame and an edged lens shape slightly larger than that.

According to this embodiment, the axial deviation measuring step can be performed by either one of image processing and visual measurement.

Furthermore, according to this embodiment, the reference position mark can be displayed either before holding the processing target lens or simultaneously with displaying the axial deviation measuring mark on the unprocessed lens.

In the embodiment described above, the processing target lens is delivered to the optician after it undergoes secondary processing into an edged lens shape complying with the frame shape of the spectacle frame selected by the user, or into an edged lens shape slightly larger than the frame shape. Depending on the request of the optician, a processing target lens having a primary shape, which has undergone only primary processing, may be delivered. In this case, if the lens has axial deviation, the optician is informed of the axial deviation amount and its direction in addition to the processing center position 21'. Upon reception of the processing target lens that has undergone primary processing, the optician finishes the processing target lens into a shape complying with the frame shape of the spectacle frame by holding the processing center position 21, and fits the processed lens into the spectacle frame, thus completing a spectacle.

Industrial Applicability

The edging method according to the present invention is usefully employed in edging a spectacle lens.

The invention claimed is:

1. A spectacle lens edging method comprising the steps of holding a processing target lens by lens holding means, mounting the lens holding means on a lens rotating shaft together with the processing target lens, processing a circumferential surface of the processing target lens using a processing tool by primary processing, correcting axial deviation of the processing target lens having undergone primary processing, and processing the axial deviation-corrected processing target lens by secondary processing, the step of holding the processing target lens by the lens holding means further comprising the steps of holding the processing target lens such that a center of the lens holding means coincides with a processing center of the processing target lens, and displaying an axial deviation measuring mark on one optical surface of the processing target lens so as to coincide with a reference position mark displayed on the lens holding means, and the step of correcting the axial deviation of the processing target lens having undergone primary processing comprising the axial deviation measuring step of removing the processing target lens from the lens rotating shaft together with the lens holding means after primary processing and measuring axial deviation of the processing target lens from the reference position mark and the axial deviation measuring mark, the axial deviation correcting step of correcting the axial deviation of the processing target lens which is measured by the axial deviation measuring step by holding one optical surface of the processing target lens with the lens holding means again such that the axial deviation measuring mark coincides with the reference position mark, and the step of mounting the lens holding means on the lens rotating shaft again together with the processing target lens.

2. A spectacle lens edging method according to claim 1, wherein a primary shape of the processing target lens processed by the primary processing step is either one of a circle larger than a circle inscribed by an edged lens shape that complies with a frame shape of a spectacle frame and an edged shape similar to and larger than the edged lens shape that complies with the frame shape, and a secondary shape of the processing target lens processed by the secondary processing step is either one of an edged lens shape that complies with the frame shape of the spectacle frame and an edged lens shape slightly larger than the edged lens shape that complies with the frame shape.

3. A spectacle lens edging method according to claim 1, wherein the axial deviation measuring step for the processing target lens is performed by either one of image processing and visual measurement.

4. A spectacle lens edging method according to claim 1, wherein the reference position mark is displayed either one of before holding the processing target lens and simultaneously with displaying the axial deviation measuring mark on an unprocessed lens.

* * * * *